US010598420B2

(12) United States Patent
Woo et al.

(10) Patent No.: US 10,598,420 B2
(45) Date of Patent: Mar. 24, 2020

(54) PLANE HEATER AND ICE MACHINE HAVING SAME

(71) Applicant: DAE CHANG CO., LTD., Jeollabuk-do (KR)

(72) Inventors: Hyeon-Cheol Woo, Gyeonggi-do (KR); Jun Dong Ji, Gyeonggi-do (KR); Kyong Su Lee, Gyeonggi-do (KR); Tae Il Kim, Gyeonggi-do (KR); Kyoung Hun Nam, Seoul (KR)

(73) Assignee: DAE CHANG CO., LTD., Jeollabuk-Do (KR)

( * ) Notice: Subject to any disclaimer, the term of this patent is extended or adjusted under 35 U.S.C. 154(b) by 590 days.

(21) Appl. No.: 15/323,791

(22) PCT Filed: Jun. 5, 2015

(86) PCT No.: PCT/KR2015/005636
§ 371 (c)(1),
(2) Date: Apr. 10, 2017

(87) PCT Pub. No.: WO2016/003081
PCT Pub. Date: Jan. 7, 2016

(65) Prior Publication Data

US 2017/0211866 A1 Jul. 27, 2017

(30) Foreign Application Priority Data

Jul. 4, 2014 (KR) ..... 10-2014-0083985
Jul. 22, 2014 (KR) ..... 10-2014-0092345

(51) Int. Cl.
*F25C 5/08* (2006.01)
*F25C 1/22* (2018.01)
(Continued)

(52) U.S. Cl.
CPC ..... *F25C 5/08* (2013.01); *F25C 1/22* (2013.01); *H05B 3/16* (2013.01); *H05B 3/267* (2013.01); *F25C 2500/02* (2013.01)

(58) Field of Classification Search
CPC ..... F25C 1/04; F25C 5/02; F25C 5/08; F25C 2500/02; H05B 3/16; H05B 3/267
(Continued)

(56) References Cited

U.S. PATENT DOCUMENTS

2007/0261427 A1* 11/2007 Kim ..... F25C 5/08 62/351
2010/0206990 A1* 8/2010 Petrenko ..... B64D 15/163 244/134 D
(Continued)

FOREIGN PATENT DOCUMENTS

JP 2001-023732 A 1/2001
JP 2010-266173 A 11/2010
(Continued)

OTHER PUBLICATIONS

International Search Report for PCT/KR2015/005636.

*Primary Examiner* — Davis D Hwu
(74) *Attorney, Agent, or Firm* — The PL Law Group, PLLC

(57) ABSTRACT

A plane heater is a plane heater arranged in an ice tray of an ice machine including the ice tray having a partitioned space arranged therein to receive ice-making water, an ejector for separating ice within the ice tray, a motor which is arranged to face the ice tray and drives the ejector therein, and a control box having a printed circuit board formed therein. The plane heater includes a heat emitting body which is formed by a metal thin film and has a thickness thicker than 0 mm and equal to and thinner than 0.5 mm, a heat insulation member arranged to cover the heat emitting body, an electrode pad electrically connected to the heat emitting body,
(Continued)

and a power source connection part including a support plate arranged below the electrode pad.

20 Claims, 17 Drawing Sheets

(51) Int. Cl.
*H05B 3/16* (2006.01)
*H05B 3/26* (2006.01)

(58) Field of Classification Search
USPC ..... 62/351
See application file for complete search history.

(56) References Cited

U.S. PATENT DOCUMENTS

2010/0319373 A1* 12/2010 Jeong ..... F25C 1/08 62/137
2011/0252816 A1* 10/2011 Kulkarni ..... F25C 5/10 62/81
2012/0318003 A1 12/2012 Kim et al.

FOREIGN PATENT DOCUMENTS

KR 10-2006-0099728 A 9/2006
KR 10-0710711 B1 4/2007
KR 10-2010-0116147 A 10/2010

* cited by examiner

PLANE HEATER AND ICE MACHINE HAVING SAME

PRIORITY

This application claims benefit under 35 U.S.C. 119(e), 120, 121, or 365(c), and is a National Stage entry from International Application No. PCT/KR2015/005636, filed Jun. 5, 2015, which claims priority to the benefit of Korean Patent Application No. 10-2014-0083985 filed in the Korean Intellectual Property Office on Jul. 4, 2014 and of Korean Patent Application No. 10-2014-0092345 filed in the Korean Intellectual Property Office on Jul. 22, 2014, the entire contents of which are incorporated herein by reference.

TECHNICAL FIELD

The present invention relates to a heater, and more particularly, to a plane heater and an ice machine having the same.

BACKGROUND ART

Generally, a refrigerator includes a refrigerator compartment which keeps food refrigerated and a freezer compartment which keeps the food frozen. At this time, an ice machine for making ice is installed at the freezer compartment or the refrigerator compartment.

FIG. 1 is a bottom view illustrating a conventional ice machine for a refrigerator.

Referring to FIG. 1, an ice machine 10 has a heater 27 provided at a lower surface of an ice tray 11. When an ice-making is completed, the heater 27 serves to slightly melt ice strongly attached to an inner surface of the ice tray 11, thereby allowing the ice to be separated. A U-shaped sheath heater was mostly used as the heater 27.

In this case, since the heater 27 is formed to be in line contact with a lower portion of the ice tray 11 in the form of a U shape, an area which is in direct contact with the ice tray 11 is small and thus heat transfer efficiency is degraded. Much of time and electric power are consumed to transfer heat to a portion of the ice tray which is not in direct contact with the heater 27 and to melt the ice in the ice tray 11. At this time, since the ice tray 11 is excessively heated by the heater 27, a lot of time is required to cool again the ice tray 11 to an ice-making temperature in an ice-making cycle after the ice is separated, and thus an ice-making time is increased. In addition, in the conventional sheath heater, since a connection between the sheath heater and a temperature fuse which cuts off power supply when the sheath heater is overheated is complicated and a connection structure which supplies electric power to the sheath heater is also complicated, it is difficult to assemble and couple corresponding elements.

SUMMARY

The present invention is directed to providing a plane heater which is capable of increasing heat transfer efficiency to an ice tray and an ice machine having the same.

Moreover, the present invention is directed to providing a plane heater which is capable of reducing an ice-making time while reducing power consumption for an entire ice-making process and an ice machine having the same.

Additionally, the present invention is directed to providing a plane heater having a simple connection structure for power supply and an ice machine having the same.

Moreover, the present invention is directed to providing a plane heater which is capable of reducing power consumption and an ice machine having the same.

One aspect of the present invention provides a plane heater provided at an ice tray of an ice machine which includes the ice tray having a partitioned space to accommodate ice-making water, an ejector configured to separate ice inside the ice tray, a motor provided to face the ice tray and configured to drive the ejector therein and a control box having a printed circuit board, the plane heater including a heat emitting body formed of a metal thin film and having a thickness thicker than 0 and equal to or thinner than 0.5 mm; a heat insulation member provided to cover the heat emitting body; and a power source connection part including an electrode pad electrically connected to the heat emitting body and a support plate provided below the electrode pad.

The electrode pad of the power source connection part may be connected to a connector provided at a printed circuit board inside the control box and may transmit electric power to the heat emitting body.

The support plate may be configured with one of a printed circuit board (PCB), a metal PCB and a plastic material.

The support plate may extend in a lengthwise direction of the plane heater, and the heat emitting body may be provided on the extending support plate, and the heat insulation member may be provided on the extending support plate to cover the heat emitting body.

The plane heater may further include a heat insulation film provided between the electrode pad and the support plate; and an adhesive member provided between the heat insulation film and the support plate to bond the heat insulation film to the support plate.

The plane heater may be formed to have a different heat emitting density according to a position corresponding to the ice tray.

The plane heater may be formed so that a portion thereof corresponding to at least one of one end of the ice tray, the other end of the ice tray and a center of the ice tray has a higher heat emitting density than that of other portions thereof.

The plane heater may be formed to have a different heat emitting surface area according to a position corresponding to the ice tray.

One side of each of the heat emitting body and the heat insulation member may be fixed to a lower surface of the power source connection part, and one end of the heat emitting body may be electrically connected to the electrode pad formed on an upper surface of the power source connection part through an insertion hole formed at the power source connection part.

The plane heater may be provided in a closed loop type at an outer circumferential surface of the ice tray, or may be formed in a partially opened loop type.

The plane heater may further include a power source disconnection part provided at the power source connection part to cut off electric power supplied to the heat emitting body of the plane heater when a temperature of the plane heater exceeds a preset temperature or a current exceeding a preset current flows.

The plane heater may further include a 1-1st electrode pad provided at the power source connection part, electrically connected to one end of the heat emitting body and connected to a connector; and a 1-2nd electrode pad provided at the power source connection part, electrically connected to the other end of the heat emitting body and connected to the connector, and the 1-1st electrode pad or the 1-2nd electrode pad may be provided so that a portion thereof electrically connected to the heat emitting body and a portion thereof connected to the connector are spaced apart from each other, and the power source disconnection part may be provided to electrically connect the spaced portions of the 1-1st electrode pad or the 1-2nd electrode pad.

The power source disconnection part may be a temperature fuse or a bimetal.

The plane heater may further include a temperature sensor provided at the power source connection part; and a second electrode pad electrically connected to the temperature sensor and connected to a connector provided at the printed circuit board inside the control box.

The plane heater may be screw-coupled to the ice tray through at least one coupling member passing through the plane heater.

A width of the electrode pad may be provided wider than that of the heat emitting body.

The power source connection part may be connected to a connector provided at the printed circuit board inside the control box, and a portion of the electrode pad which is connected to the connector may be provided to have a width or a surface area wider than that of a portion thereof connected to the heat emitting body.

The power source connection part may be connected to a connector provided at the printed circuit board inside the control box, and the plane heater may further include a shrinkable tube provided to cover a portion except the power source connection part connected to the connector.

The shrinkable tube may be cross-linked by electron beam irradiation.

An outer cover of the plane heater may be cross-linked by electron beam irradiation.

The plane heater may include a first plane heater part of which one end is connected to the power source connection part and which is provided at one side of an outer circumferential surface of the ice tray along a lengthwise direction of the ice tray;

and a second plane heater part of which one end is connected to the power source connection part and which is provided at the other side of an outer circumferential surface of the ice tray along the lengthwise direction of the ice tray.

The power source connection part may be connected to a connector provided at the printed circuit board inside the control box, and a plurality of heat emitting bodies are provided to be branched from the power source connection part.

The power source connection part may be provided to be biased to one side based on a center of a lengthwise direction of the plane heater.

A plurality of electrode pads may be provided at the power source connection part, and the power source connection part may further include a partition part provided between the electrode pads on the support plate.

The electrode pad may be fixed to the support plate by a coupling member provided to pass through the power source connection part.

The electrode pad may be provided along a lengthwise direction of the support plate to a distal end of the support plate on an upper surface of the support plate and may extend from the distal end of the support plate to a lower surface of the support plate in a predetermined length, and the coupling member may pass through from the electrode pad provided on the upper surface of the support plate to the electrode pad provided at the lower surface of the support plate and may couple and fix the electrode pad to the support plate.

The plane heater may further include an electrode pad guide part provided at the support plate and provided along the electrode pad at a side portion of the electrode pad.

The plane heater may further include a metal connection member fitted to an end of the power source connection part, electrically connected to the electrode pad and fixed to the support plate, and the power source connection part may be connected to a connector in which the metal connection member is provided at the printed circuit board inside the control box.

The metal connection member may be provided along a lengthwise direction of the support plate to a distal end of the support plate on an upper surface of the support plate and may extend from the distal end of the support plate to a lower surface of the support plate in a predetermined length, and the coupling member may pass through from the metal connection member provided on the upper surface of the support plate to the metal connection member provided at the lower surface of the support plate and may couple and fix the metal connection member to the support plate.

The plane heater may further include a power source disconnection part configured to cut off power source applied to the heat emitting body under a preset to condition, and the power source disconnection part may be provided at the ice tray.

The power source disconnection part may be accommodated and fixed into an accommodation groove provided at a surface of the ice tray facing the control box.

The plane heater may further include a 1-1st electrode pad provided at the power source connection part and electrically connected to one end of the heat emitting body of the plane heater; and a 1-2nd electrode pad provided at the power source connection part and spaced apart from the other end of the heat emitting body of the plane heater, and the power source disconnection part may be electrically connected to the other end of the heat emitting body by a first connection part and may be electrically connected to the 1-2nd electrode pad by a second connection part.

One end of each of the first connection part and the second connection part may be connected to the power source disconnection part, and the other end thereof may be connected to a coupling member passing through and coupled to the power source connection part.

The heat emitting body, the 1-1st electrode pad and the 1-2nd electrode pad may be connected by an arc welding or an electric welding.

Another aspect of the present invention provides a plane heater provided at an ice tray of an ice machine which includes the ice tray having a partitioned space to accommodate ice-making water, an ejector configured to separate ice inside the ice tray, a motor provided to face the ice tray and configured to drive the ejector therein and a control box having a printed circuit board, the plane heater including a heat emitting body formed of a metal thin film and having a thickness thicker than 0 and equal to or thinner than 0.5 mm; a heat insulation member provided to cover the heat emitting body; a lead wire configured to electrically connect the heat emitting body with the printed circuit board; and a power source disconnection part provided at the ice tray, connected to the heat emitting body and the lead wire and configured to cut off electric power applied to the heat emitting body of the plane heater under a preset condition.

The heat emitting body and the lead wire may be connected by an arc welding or an electric welding.

An accommodation groove may be provided at a surface of the ice tray facing the control box, and the power disconnection part may be accommodated and fixed into the accommodation groove.

The ice tray may include a first tray formed of a metal thin film and a second tray formed of a resin, and the plane heater may be provided between the first tray and the second tray.

According to the embodiment of the present invention, since the plane heater is provided to be in surface contact with the outer circumferential surface of the ice tray, a surface area which is in contact with the ice tray can be increased, and thus heat transfer efficiency from the plane heater to the ice tray can be increased, and ice frozen to an inner surface of the ice tray can be melted even with small quantity of heat and a short operating time. Moreover, since the heat insulation member is provided at the other surface of the plane heater, a loss of heat which leaks to an outside of the ice tray can be prevented.

Moreover, since the plane heater is in close contact with the ice tray by an adhesive member or a heater pressing part, the heat transfer efficiency from the plane heater to the ice tray can be increased.

In addition, since the plane heater is formed in a thin film type and thermal capacity of the plane heater is reduced, the plane heater can be heated to a predetermined temperature within a short time, and a power consumption of the plane heater can be reduced.

Moreover, since an operation of a first plane heater and a second plane heater is controlled according to a rotational position of the ejector or an operating time of the ejector, the power consumption necessary to melt the ice frozen to the inner surface of the ice tray can be reduced.

Additionally, since the plane heater is provided in a module type including the power source connection part configured with the PCB or the metal PCB, the power source disconnection part, the temperature sensor or the like can be formed at the power source connection part through a simple structure and circuit.

In addition, since the power source connection part of the plane heater is connected to the connector provided at the control box, a power supply connection structure of the plane heater can be simplified, and the power source connection part of the plane heater can be easily connected or disconnected to the connector (in one-touch method).

DETAILED DESCRIPTION

Hereinafter, specific embodiments of a plane heater and an ice machine including the same of the present invention will be described with reference to FIGS. 2 to 17(B). However, the embodiments are merely examples, and the present invention is not limited thereto.

In the following description, if it is considered that the specific description of the related and noticed functions or structures may obscure the gist of the present invention, the specific description will be omitted. In addition, the terms used herein are defined according to the functions of the present invention. Thus, the terms may vary depending on user's or operator's intentions or practices. Therefore, the terms used herein must be understood based on the descriptions made herein.

The technical spirit of the present invention is determined by the claims, and the following embodiments are provided to merely explain the technical spirit of the present invention to those skilled in the art to which the present invention pertains.

Figure 1:
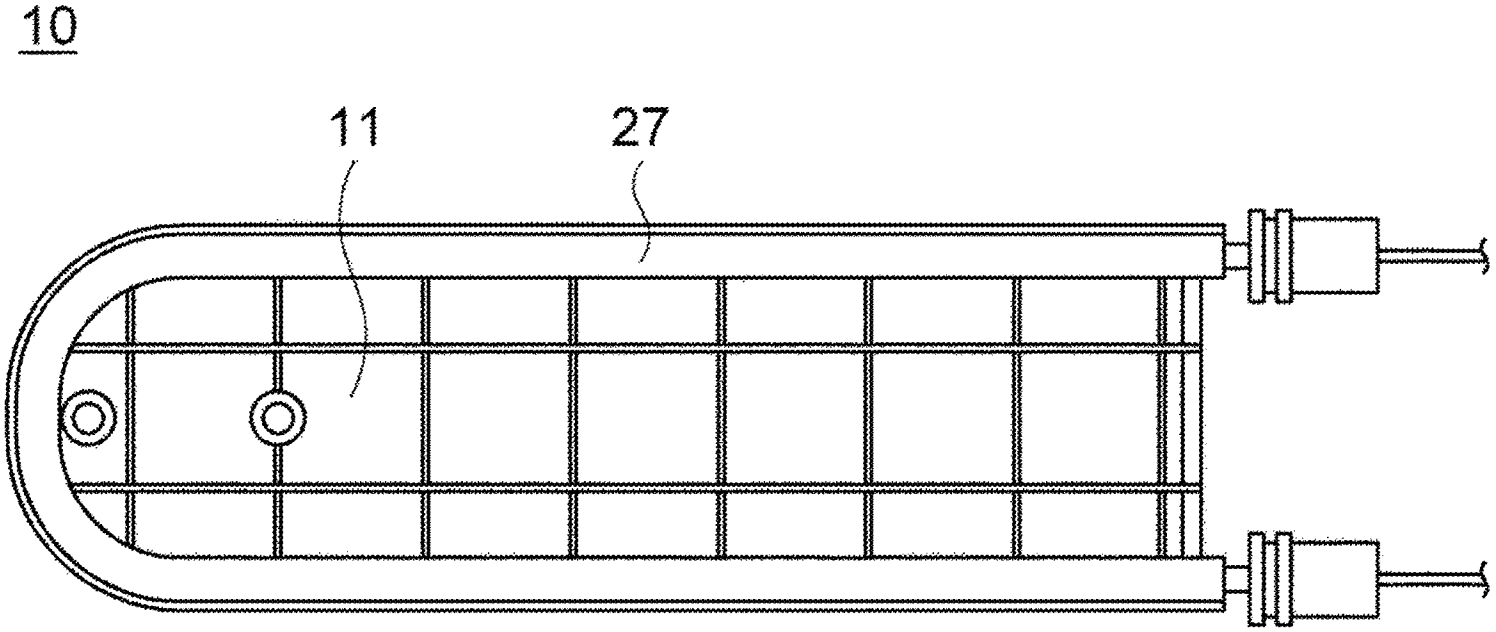
FIG. 1 is a bottom view illustrating an ice machine for a conventional refrigerator.
Figure 2:
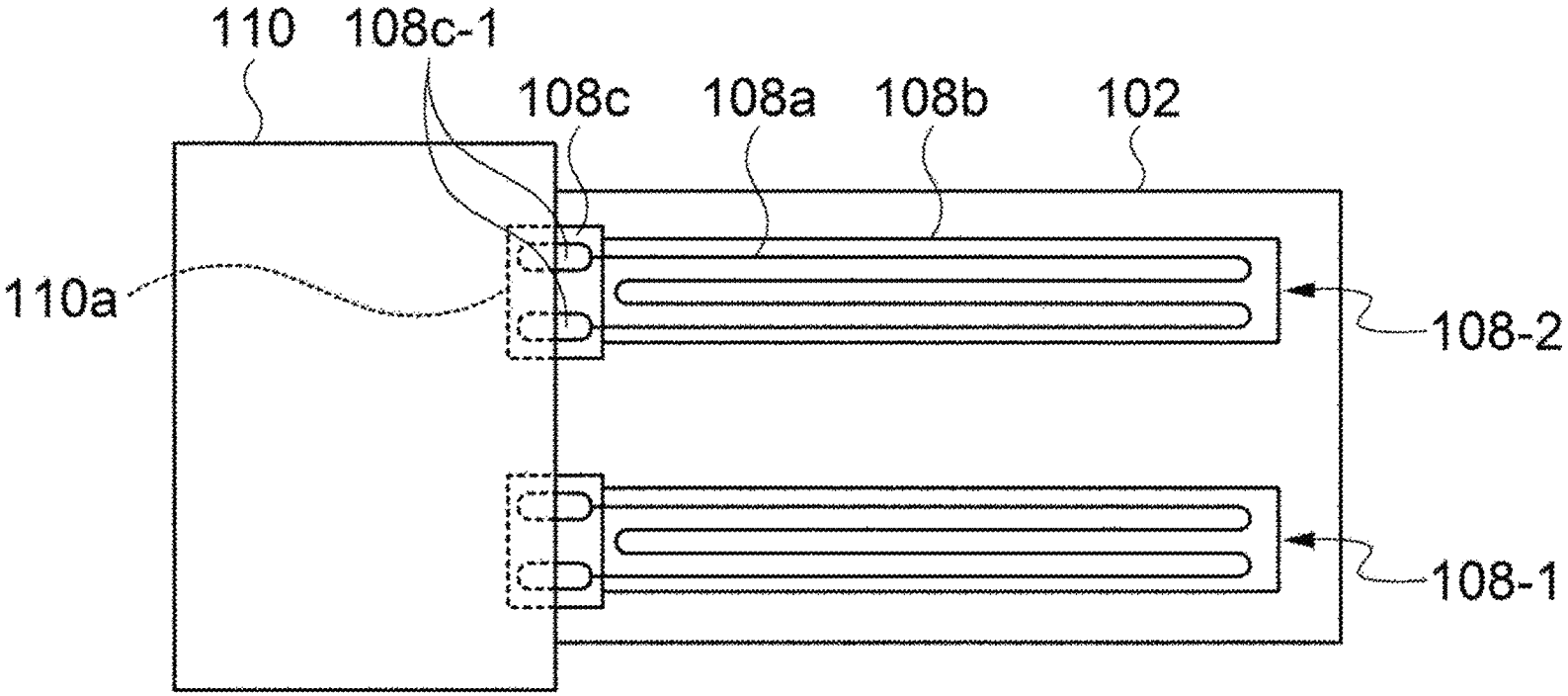
FIG. 2 is a bottom view illustrating an ice machine according to one embodiment of the present invention.

FIG. 2 is a bottom view illustrating an ice machine according to one embodiment of the present invention.

Referring to FIG. 2, an ice machine 100 includes an ice tray 102, a plane heater 108 and a control box 110.

The ice tray 102 has an ice-making space which accommodates water therein. A plurality of partition walls may be formed inside the ice tray 102 and may divide the ice-making space into a plurality of spaces.

The plane heater 108 may be provided to be in surface contact with an outer circumferential surface of the ice tray 102. The plane heater 108 may be provided along a lengthwise direction of the ice tray 102. The plane heater 108 may generate heat over a predetermined area. The plane heater 108 may be formed in a thin film type. For example, the plane heater 108 may be formed to have a thickness thicker than 0 mm and equal to or thinner than 1 mm. A lower-bound value of the thickness of the plane heater 108 may be appropriately set by those skilled in the art according to materials of a heat emitting body and a heat insulation member forming the plane heater 108. Since the plane heater 108 is formed in the thin film type and a thermal capacity of the plane heater 108 is reduced, the plane heater 108 may be heated to a predetermined temperature within a short time. In this case, a power consumption of the plane heater 108 may be reduced. For example, a positive temperature coefficient (PTC) heater may be used as the plane heater 108, but the present invention is not limited thereto.

The plane heater 108 may include a heat emitting body 108*a*, a heat insulation member 108*b* and a power source connection part 108*c*. The heat emitting body 108*a* may be provided on an entire area of the plane heater 108 to generate heat. For example, the heat emitting body 108*a* may be provided on the entire area of the plane heater 108 in zigzags. For example, the heat emitting body 108*a* may be formed of a metal thin film such as a stainless thin film, platinum thin film, a tungsten thin film and a nickel thin film, but the present invention is not limited thereto. The heat emitting body 108*a* may be formed by a thin film coating of carbon nanotube, carbon nanoplate or the like. The heat emitting body 108*a* may be formed to have a thickness thicker than 0 mm and equal to or thinner than 0.5 mm. A lower-bound value of the thickness of the heat emitting body 108*a* may be appropriately set by those skilled in the art according to a material of the heat emitting body.

The heat insulation member 108*b* may be provided to cover the heat emitting body 108*a*. The heat insulation member 108*b* may be formed of a polyimide or graphene material. In this case, even when the heat emitting body 108*a* is heated to a high temperature or an external impact is applied thereto, the heat emitting body 108*a* may be protected safely. However, the present invention is not limited thereto, and the heat insulation member 108*b* may be formed of various other heat insulation materials. The heat insulation member 108*b* may be formed in a thin film type. The heat insulation member 108*b* may include a first heat insulation member provided at one surface of the heat emitting body 108*a* to cover the heat emitting body 108*a* and a second heat insulation member provided at the other surface of the heat emitting body 108*a* to cover the heat emitting body 108*a*.

The power source connection part 108*c* may be provided at a distal end of the plane heater 108. The power source connection part 108*c* may be configured with a printed circuit board (PCB) or a metal PCB. An electrode pad 108*c*-1 to which both ends of the heat emitting body 108*a* are electrically connected may be formed at the power source connection part 108*c*. An insulation member (not shown) which covers the electrode pad 108*c*-1 may be formed at the electrode pad 108*c*-1 of the power source connection part 108*c* to which the heat emitting body 108*a* is connected. The power source connection part 108*c* may be connected to a connector 110*a* provided inside the control box 110. At this time, the electrode pad 108*c*-1 of the power source connection part 108*c* may be electrically connected to the connector 110*a*. The power source connection part 108*c* is electrically connected to a power supply part (not shown) through the connector 110*a* and serves to apply electric power transmitted from the power supply part (not shown) to the heat emitting body 108*a*. The power supply part (not shown) may be provided inside the control box 110 but is not limited thereto. The power supply part (not shown) may be provided at another portion (e.g., a controller) of a refrigerator at which the ice machine 100 is installed.

The plane heater 108 may include a first plane heater 108-1 provided at one side surface of the outer circumferential surface of the ice tray 102 along a lengthwise direction of the ice tray 102 and a second plane heater 108-2 provided at the other side surface of the outer circumferential surface of the ice tray 102 along the lengthwise direction of the ice tray 102. For example, the plane heater 108 may be bonded to the ice tray 102 through a polyimide adhesive. However, the present invention is not limited thereto, and the plane heater 108 may be bonded to the ice tray 102 through an adhesive paste including thermal conductive powder. In this case, the plane heater 108 may be bonded to the ice tray 102, and heat generated from the plane heater 108 may also be effectively transferred to the ice tray 102. A heat insulation member (not shown) may be provided at the other surface of the plane heater 108. The heat insulation member (not shown) serves to prevent the heat generated from the plane heater 108 from leaking to an outside of the ice tray 102. In this case, heat transfer efficiency in which the heat generated from the plane heater 108 is transferred to an inside of the ice tray 102 may be increased.

Here, since the plane heater 108 is provided to be in surface contact with the ice tray 102, an area which is in contact with the ice tray 102 may be increased. In this case, since the heat transfer efficiency from the plane heater 108 to the ice tray 102 may be increased, ice frozen to an inner surface of the ice tray 102 may be melted even with small quantity of heat and a short operating time. In addition, since the first plane heater 108-1 and the second plane heater 108-2 are provided at both side surfaces of the outer circumferential surface of the ice tray 102 and the heat insulation member (not shown) is provided at each of the other surfaces of the first plane heater 108-1 and the second plane heater 108-2, the heat may be rapidly transferred to an entire inner area of the ice tray 102 through the first plane heater 108-1 and the second plane heater 108-2.

Meanwhile, a cool air contact section may be provided at a lower surface portion of the outer circumferential surface of the ice tray 102. That is, an area of the outer circumferential surface of the ice tray 102 which is located between the first plane heater 108-1 and the second plane heater 108-2 may be exposed to an outside. The cool air contact section is an area in which the ice tray 102 comes in contact with cool air in an ice-making compartment and serves to allow a temperature of the ice tray 102 to reach an ice-making temperature within a short time.

That is, when the first plane heater 108-1 and the second plane heater 108-2 heat the ice tray 102 and slightly melt the ice frozen to the inner circumferential surface of the ice tray 102, an ejector (not shown) is rotated to separate and move the ice to an ice bank (not shown). Then, ice-making water is supplied into the ice tray 102, and an ice-making process is performed again. At this time, since the area in which the ice tray 102 is in contact with the cool air in the ice-making compartment is ensured by the cool air contact section, the temperature of the ice tray 102 may reach the ice-making temperature within a short time, and thus an entire ice-making time may be reduced.

The control box 110 may be provided at one side of the ice tray 102. The control box 110 may be coupled to the ice tray 102 at one side of the ice tray 102. A controller (not shown) which controls an entire operation of the ice machine 100 may be provided at the control box 110. In addition, an ice separating motor (not shown) which rotates the ejector (not shown) in a predetermined direction may be provided at the control box 110. The power supply part (not shown) which supplies the electric power to the ice separating motor (not shown) and the plane heater 108 may be provided at the control box 110.

According to the embodiment of the present invention, since the plane heater 108 is provided to be in surface contact with the outer circumferential surface of the ice tray 102, the area which comes in contact with the ice tray 102 may be increased, and thus the heat transfer efficiency from the plane heater 108 to the ice tray 102 may be increased, and the ice frozen to the inner surface of the ice tray 102 may be melted even with the small quantity of heat and the short operating time. Moreover, since the heat insulation member (not shown) is provided at the other surface of the plane heater 108, a loss of heat which leaks to an outside of the ice tray 102 may be prevented. Additionally, since the plane heater 108 is formed in the thin film type and the thermal capacity of the plane heater 108 is reduced, the plane heater 108 may be heated to a predetermined temperature within a short time, and the power consumption of the plane heater 108 may be reduced.

FIG. 2 is a bottom view illustrating an ice machine according to one embodiment of the present invention.

Referring to FIG. 2, an ice machine 100 includes an ice tray 102, a plane heater 108 and a control box 110.

The ice tray 102 has an ice-making space which accommodates water therein. A plurality of partition walls may be formed inside the ice tray 102 and may divide the ice-making space into a plurality of spaces.

The plane heater 108 may be provided to be in surface contact with an outer circumferential surface of the ice tray 102. The plane heater 108 may be provided along a lengthwise direction of the ice tray 102. The plane heater 108 may generate heat over a predetermined area. The plane heater 108 may be formed in a thin film type. For example, the plane heater 108 may be formed to have a thickness thicker than 0 mm and equal to or thinner than 1 mm. A lower-bound value of the thickness of the plane heater 108 may be appropriately set by those skilled in the art according to materials of a heat emitting body and a heat insulation member forming the plane heater 108. Since the plane heater 108 is formed in the thin film type and a thermal capacity of the plane heater 108 is reduced, the plane heater 108 may be heated to a predetermined temperature within a short time. In this case, a power consumption of the plane heater 108 may be reduced. For example, a positive temperature coefficient (PTC) heater may be used as the plane heater 108, but the present invention is not limited thereto.

The plane heater 108 may include a heat emitting body 108*a*, a heat insulation member 108*b* and a power source connection part 108*c*. The heat emitting body 108*a* may be provided on an entire area of the plane heater 108 to generate heat. For example, the heat emitting body 108*a* may be provided on the entire area of the plane heater 108 in zigzags. For example, the heat emitting body 108*a* may be formed of a metal thin film such as a stainless thin film, platinum thin film, a tungsten thin film and a nickel thin film, but the present invention is not limited thereto. The heat emitting body 108*a* may be formed by a thin film coating of carbon nanotube, carbon nanoplate or the like. The heat emitting body 108*a* may be formed to have a thickness thicker than 0 mm and equal to or thinner than 0.5 mm. A lower-bound value of the thickness of the heat emitting body 108*a* may be appropriately set by those skilled in the art according to a material of the heat emitting body.

The heat insulation member 108*b* may be provided to cover the heat emitting body 108*a*. The heat insulation member 108*b* may be formed of a polyimide or graphene material. In this case, even when the heat emitting body 108*a* is heated to a high temperature or an external impact is applied thereto, the heat emitting body 108*a* may be protected safely. However, the present invention is not limited thereto, and the heat insulation member 108*b* may be formed of various other heat insulation materials. The heat insulation member 108*b* may be formed in a thin film type. The heat insulation member 108*b* may include a first heat insulation member provided at one surface of the heat emitting body 108*a* to cover the heat emitting body 108*a* and a second heat insulation member provided at the other surface of the heat emitting body 108*a* to cover the heat emitting body 108*a*.

The power source connection part 108*c* may be provided at a distal end of the plane heater 108. The power source connection part 108*c* may be configured with a printed circuit board (PCB) or a metal PCB. An electrode pad 108*c*-1 to which both ends of the heat emitting body 108*a* are electrically connected may be formed at the power source connection part 108*c*. An insulation member (not shown) which covers the electrode pad 108*c*-1 may be formed at the electrode pad 108*c*-1 of the power source connection part 108*c* to which the heat emitting body 108*a* is connected. The power source connection part 108*c* may be connected to a connector 110*a* provided inside the control box 110. At this time, the electrode pad 108*c*-1 of the power source connection part 108*c* may be electrically connected to the connector 110*a*. The power source connection part 108*c* is electrically connected to a power supply part (not shown) through the connector 110*a* and serves to apply electric power transmitted from the power supply part (not shown) to the heat emitting body 108*a*. The power supply part (not shown) may be provided inside the control box 110 but is not limited thereto. The power supply part (not shown) may be provided at another portion (e.g., a controller) of a refrigerator at which the ice machine 100 is installed.

The plane heater 108 may include a first plane heater 108-1 provided at one side surface of the outer circumferential surface of the ice tray 102 along a lengthwise direction of the ice tray 102 and a second plane heater 108-2 provided at the other side surface of the outer circumferential surface of the ice tray 102 along the lengthwise direction of the ice tray 102. For example, the plane heater 108 may be bonded to the ice tray 102 through a polyimide adhesive. However, the present invention is not limited thereto, and the plane heater 108 may be bonded to the ice tray 102 through an adhesive paste including thermal conductive powder. In this case, the plane heater 108 may be bonded to the ice tray 102, and heat generated from the plane heater 108 may also be effectively transferred to the ice tray 102. A heat insulation member (not shown) may be provided at the other surface of the plane heater 108. The heat insulation member (not shown) serves to prevent the heat generated from the plane heater 108 from leaking to an outside of the ice tray 102. In this case, heat transfer efficiency in which the heat generated from the plane heater 108 is transferred to an inside of the ice tray 102 may be increased.

Here, since the plane heater 108 is provided to be in surface contact with the ice tray 102, an area which is in contact with the ice tray 102 may be increased. In this case, since the heat transfer efficiency from the plane heater 108 to the ice tray 102 may be increased, ice frozen to an inner surface of the ice tray 102 may be melted even with small quantity of heat and a short operating time. In addition, since the first plane heater 108-1 and the second plane heater 108-2 are provided at both side surfaces of the outer circumferential surface of the ice tray 102 and the heat insulation member (not shown) is provided at each of the other surfaces of the first plane heater 108-1 and the second plane heater 108-2, the heat may be rapidly transferred to an entire inner area of the ice tray 102 through the first plane heater 108-1 and the second plane heater 108-2.

Meanwhile, a cool air contact section may be provided at a lower surface portion of the outer circumferential surface of the ice tray 102. That is, an area of the outer circumferential surface of the ice tray 102 which is located between the first plane heater 108-1 and the second plane heater 108-2 may be exposed to an outside. The cool air contact section is an area in which the ice tray 102 comes in contact with cool air in an ice-making compartment and serves to allow a temperature of the ice tray 102 to reach an ice-making temperature within a short time.

That is, when the first plane heater 108-1 and the second plane heater 108-2 heat the ice tray 102 and slightly melt the ice frozen to the inner circumferential surface of the ice tray 102, an ejector (not shown) is rotated to separate and move the ice to an ice bank (not shown). Then, ice-making water is supplied into the ice tray 102, and an ice-making process is performed again. At this time, since the area in which the ice tray 102 is in contact with the cool air in the ice-making compartment is ensured by the cool air contact section, the temperature of the ice tray 102 may reach the ice-making temperature within a short time, and thus an entire ice-making time may be reduced.

The control box 110 may be provided at one side of the ice tray 102. The control box 110 may be coupled to the ice tray 102 at one side of the ice tray 102. A controller (not shown) which controls an entire operation of the ice machine 100 may be provided at the control box 110. In addition, an ice separating motor (not shown) which rotates the ejector (not shown) in a predetermined direction may be provided at the control box 110. The power supply part (not shown) which supplies the electric power to the ice separating motor (not shown) and the plane heater 108 may be provided at the control box 110.

According to the embodiment of the present invention, since the plane heater 108 is provided to be in surface contact with the outer circumferential surface of the ice tray 102, the area which comes in contact with the ice tray 102 may be increased, and thus the heat transfer efficiency from the plane heater 108 to the ice tray 102 may be increased, and the ice frozen to the inner surface of the ice tray 102 may be melted even with the small quantity of heat and the short operating time. Additionally, since the heat insulation member (not shown) is provided at the other surface of the plane heater 108, a loss of heat which leaks to an outside of the ice tray 102 may be prevented. In addition, since the plane heater 108 is formed in the thin film type and the thermal capacity of the plane heater 108 is reduced, the plane heater 108 may be heated to a predetermined temperature within a short time, and the power consumption of the plane heater 108 may be reduced.

Figure 3A:
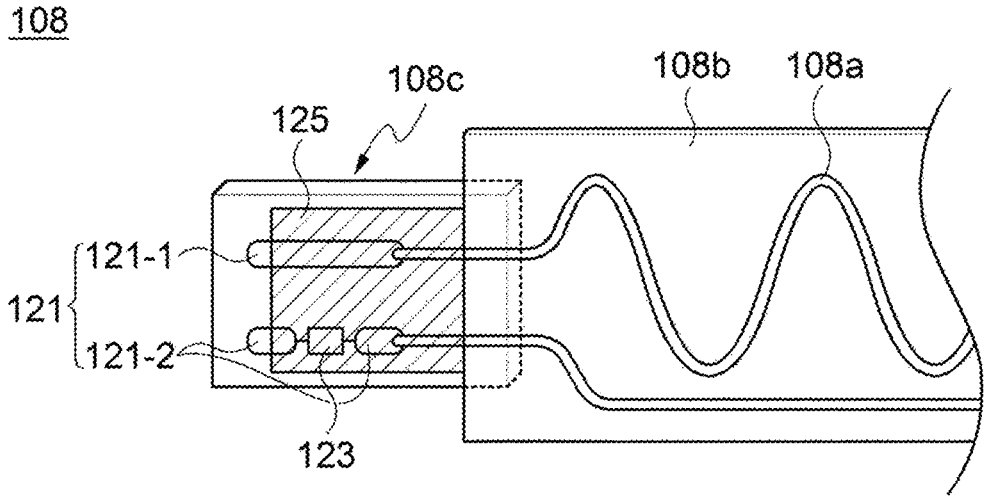
FIGS. 3(A) and 3(B) are views illustrating a plane heater according to a first embodiment of the present invention.
Figure 3B:
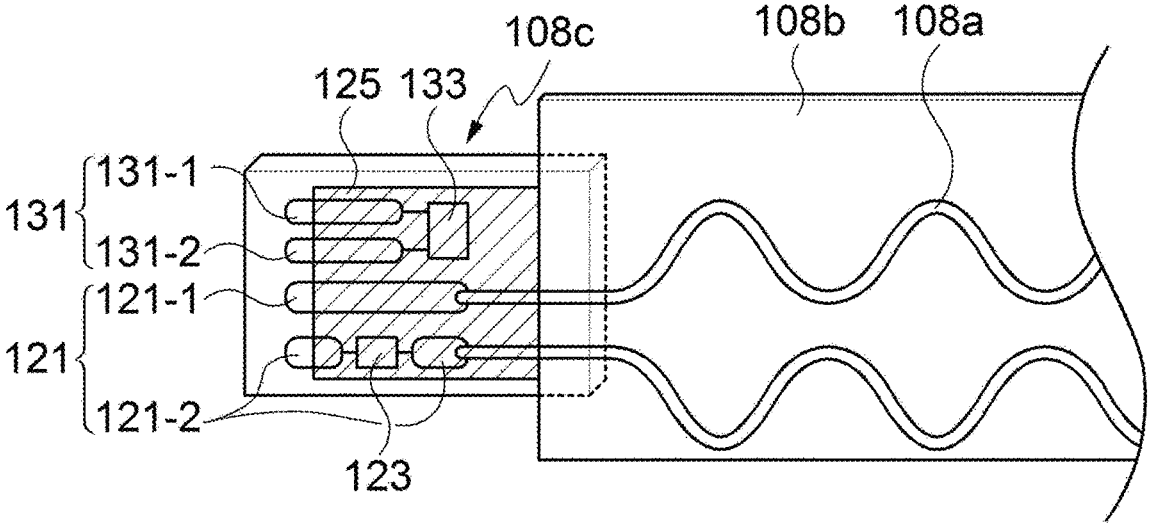

FIGS. 3(A) and 3(B) are views illustrating a plane heater according to a first embodiment of the present invention.

Referring to FIG. 3(A), a plane heater 108 may include a heat emitting body 108*a*, a heat insulation member 108*b* and a power source connection part 108*c*.

The power source connection part 108*c* may be configured with a printed circuit board (PCB) or a metal PCB. The power source connection part 108*c* may include a first electrode pad 121, a power source disconnection part 123 and a heat insulation layer 125. The first electrode pad 121 may include a 1-1st electrode pad 121-1 to which one end of the heat emitting body 108*a* is electrically connected and a 1-2nd electrode pad 121-2 provided to be spaced apart from the 1-1st electrode pad 121-1 and to which the other end of the heat emitting body 108*a* is electrically connected. The first electrode pad 121 may be connected to a connector 110*a* provided inside a control box 110. The 1-2nd electrode pad 121-2 may be provided so that a portion thereof to which the other end of the heat emitting body 108*a* is electrically connected and a portion thereof connected to the connector 110*a* are spaced apart from each other.

The power source disconnection part 123 may be provided to electrically connect the portions of the 1-2nd electrode pad 121-2 which are spaced apart from each other, but the present invention is not limited thereto. The 1-1st electrode pad 121-1 may be provided so that portions thereof are spaced apart from each other, and the power source disconnection part 123 may be provided to electrically connect the portions of the 1-1st electrode pad 121-1 which are spaced apart from each other. The power source disconnection part 123 serves to cut off electric power applied to the heat emitting body 108*a* when a temperature of the heat emitting body 108*a* exceeds a preset temperature. The power source disconnection part 123 may be configured with a temperature fuse or a bimetal but is not limited thereto. In this case, the power source disconnection part 123 may be configured without a separate temperature sensor. Furthermore, the power source disconnection part 123 may also cut off the electric power applied to the heat emitting body 108*a* when an excessive current flows to the heat emitting body 108*a*. As described above, since the plane heater 108 is provided in a module type including the power source connection part 108*c* configured with the PCB or the metal PCB, the power source disconnection part 123 may be formed at the power source connection part 108*c* through a simple structure and circuit.

The heat insulation layer 125 may be provided on the power source connection part 108*c* to cover the heat emitting body 108*a*, the electrode pad 121 and the power source disconnection part 123. The heat insulation layer 125 may serve to protect the heat emitting body 108*a*, the electrode pad 121 and the power source disconnection part 123 from an external environment. The heat insulation layer 125 is not provided at a portion of the electrode pad 121 which is connected to the connector 110*a*.

Referring to FIG. 3(B), a second electrode pad 131 and a temperature sensor 133 may be provided at the power source connection part 108*c* of the plane heater 108. The temperature sensor 133 may measure a temperature of the plane heater 108. The temperature sensor 133 is electrically connected to the second electrode pad 131. Moreover, the second electrode pad 131 is connected to the connector 110*a* provided inside the control box 110. The temperature sensor 133 may transmit measured temperature information to the controller (not shown) through the connector 110*a*. The controller (not shown) may generate a control signal to the power source disconnection part 123 to cut off the electric power applied to the heat emitting body 108*a* when a temperature of the plane heater 108 exceeds a preset temperature. At this time, the power source disconnection part 123 may be configured with a switch device. Meanwhile, the temperature sensor 133 may be provided to measure a temperature of the ice tray 102.

Meanwhile, an outer cover of the plane heater 108 may be cross-linked by electron beam irradiation. For example, a separate insulation layer may be formed at the heat insulation member 108*b* of the plane heater 108. The insulation layer may be cross-linked by the electron beam irradiation. Alternatively, the heat insulation member 108*b* may be formed of ethylene vinyl acetate (EVA) or polyethylene (PE) which is cross-linked by the electron beam irradiation. For example, in the case in which the heat insulation member 108*b* may be formed of polyethylene (PE), when accelerated electron beams are irradiated to the insulation member 108*b*, a radical is generated while H ions are dissociated from a PE chain, and the cross-linking is performed by bonding of the radicals. At this time, since polyethylene (PE) has a reticular structure by the bonding of the radicals, a heat resistant temperature of the heat insulation member 108*b* may be enhanced, and brittleness of the plane heater 108 may be enhanced.

In addition, the outer cover of the plane heater 108 may be a shrinkable tube. For example, the shrinkable tube may be provided to cover the heat insulation member 108*b* of the plane heater 108. Alternatively, the shrinkable tube may be used as the heat insulation member 108*b*. The shrinkable tube may be a shrinkable tube which is cross-lined by the electron beam irradiation.

Figure 4A:
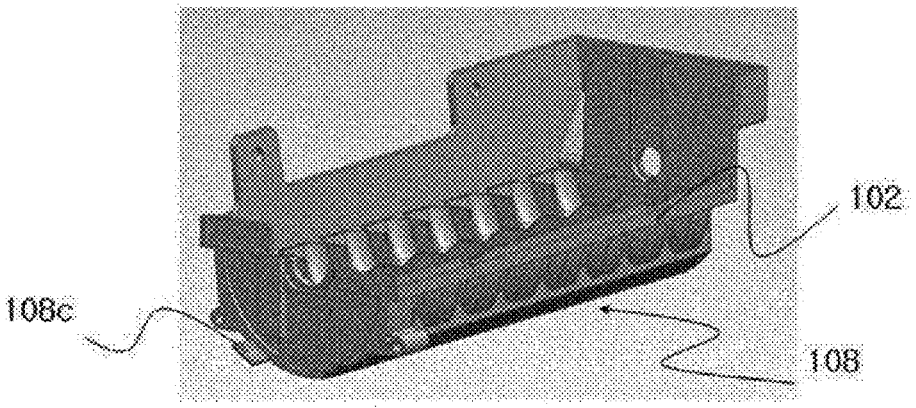
FIGS. 4(A) and 4(B) are views illustrating a state in which the plane heater according to the embodiment of the present invention is installed at an ice tray.
Figure 4B:
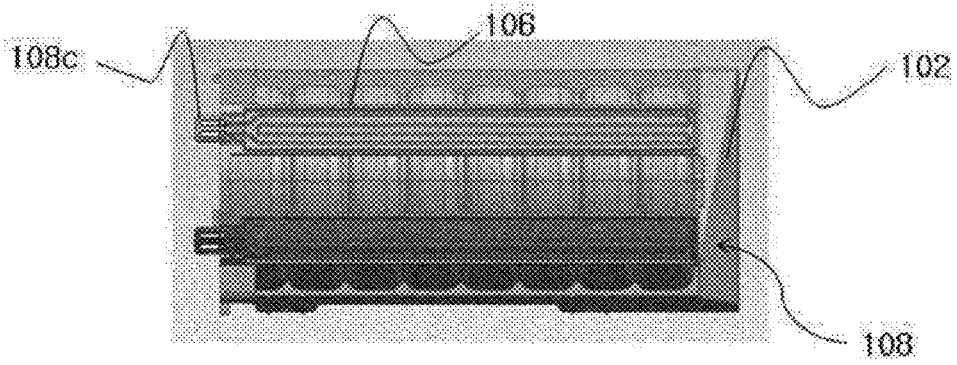

FIGS. 4(A) and 4(B) are views illustrating a state in which the plane heater according to the embodiment of the present invention is installed at the ice tray.

Referring to FIGS. 4(A) and 4(B), the plane heater 108 may be accommodated and installed at a heater accommodation part 106 provided at the outer circumferential surface of the ice tray 102. The heater accommodation part 106 may be provided at one side and the other side of the outer circumferential surface of the ice tray 102 along the lengthwise direction of the ice tray 102. The power source connection part 108*c* for applying the electric power to the plane heater 108 may be provided at the plane heater 108. At this time, one side of the power source connection part 108*c* is installed at the outer circumferential surface of the ice tray 102, and the other side of the power source connection part 108*c* may be provided to protrude to a control box (not shown). The other side of the power source connection part 108*c* may be inserted into the control box (not shown) and may be connected to a connector inside the control box (not shown). The plane heater 108 may be configured with a single PCB or metal PCB. That is, the power source connection part 108*c* may be configured with the PCB or the metal PCB, and the heat emitting body 108*a* may also be provided on the PCB or the metal PCB extending from the power source connection part 108*c*, and the heat insulation member 108*b* may be provided on the extending PCB or metal PCB to cover the heat emitting body 108*a*.

Figure 5:
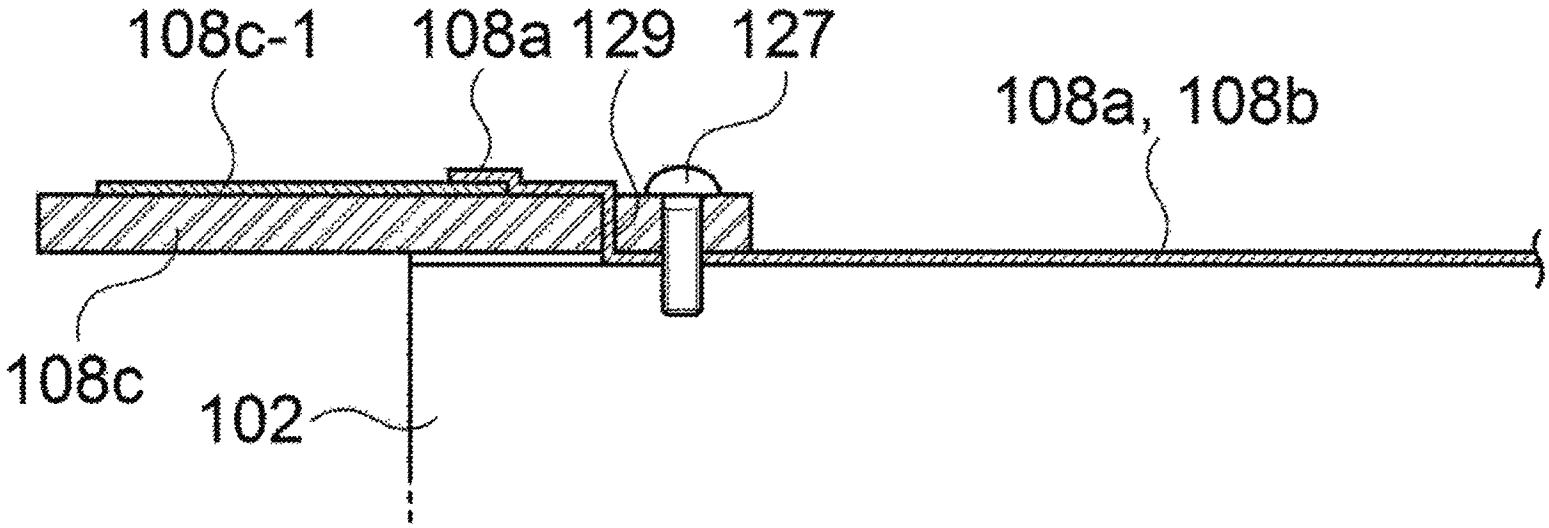
FIG. 5 is a cross-sectional view illustrating another example in which a power source connection part of the plane heater according to the embodiment of the present invention is installed at the ice tray.

FIG. 5 is a cross-sectional view illustrating another example in which the power source connection part of the plane heater according to the embodiment of the present invention is installed at the ice tray.

Referring to FIG. 5, the power source connection part 108*c* may be coupled to the ice tray 102 through a coupling member 127. For example, the coupling member 127 may be a bolt, a screw, an eyelet, a rivet or the like. The coupling member 127 may pass through the power source connection part 108*c* and may couple the power source connection part 108*c* with the ice tray 102. In addition, an insertion hole 129 may be formed at the power source connection part 108*c*. The insertion hole 129 may be provided to pass through the power source connection part 108*c* in a thickness direction of the power source connection part 108*c*.

The heat emitting body 108*a* and the heat insulation member 108*b* of the plane heater 108 may be in close contact with the outer circumferential surface of the ice tray 102. One end of each of the heat emitting body 108*a* and the heat insulation member 108*c* may be in close contact with the outer circumferential surface of the ice tray 102 by pressing of the power source connection part 108*c* at a lower portion of the power source connection part 108*c*. Moreover, one end of the heat emitting body 108*a* may be inserted into the insertion hole 129 to be exposed to the outside and then may be electrically connected to the electrode pad 108*c*-1. In this case, while an entire area of the heat emitting body 108*a* and the heat insulation member 108*b* are in close contact with the ice tray 102, an electrical connection between the heat emitting body 108*a* and the electrode pad 108*c*-1 may be stably maintained. Meanwhile, the insulation layer (not shown) may be provided to cover a part of each of the heat emitting body 108*a* and the electrode pad 108*c*-1 which is exposed to the outside.

Figure 6A:
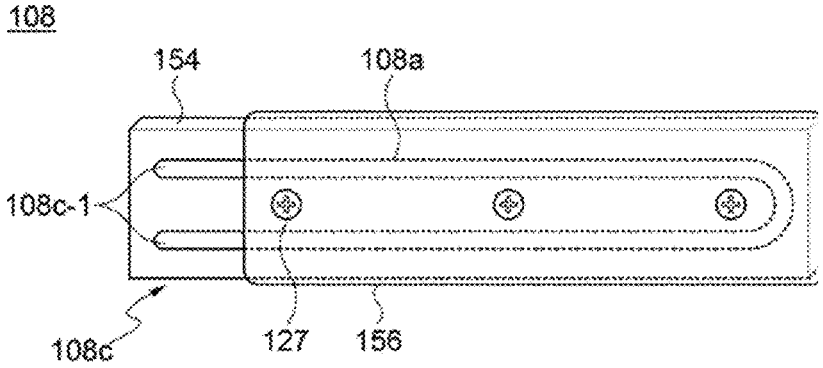
FIGS. 6(A) and 6(B) are views illustrating a plane heater according to a second embodiment of the present invention.
Figure 6B:
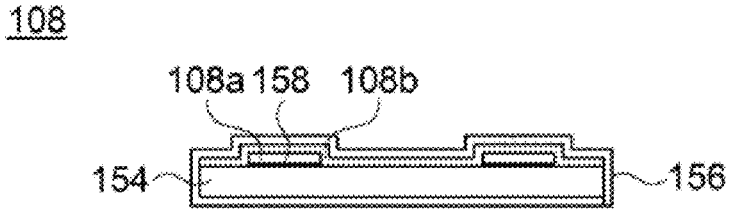

FIGS. 6(A) and 6(B) are views illustrating a plane heater according to a second embodiment of the present invention.

Referring to FIGS. 6(A) and 6(B), an entire area of a plane heater 108 may be configured with a printed circuit board (PCB) (or a metal PCB) 154. That is, a base member of the plane heater 108 may be configured with the printed circuit board (PCB) (or the metal PCB) 154. At this time, an electrode pad 108*c*-1 and a heat emitting body 108*a* may be formed on one surface of the PCB 154. The electrode pad 108*c*-1 and the heat emitting body 108*a* may be integrally formed with each other, but the present invention is not limited thereto. Furthermore, the heat emitting body 108*a* may be formed of a metal thin film which is thicker than 0 and equal to or thinner than 0.5 mm and then may be bonded to one surface of the PCB 154 through an adhesive 158. A heat insulation member 108*b* may be provided at the one surface of the PCB 154 to cover the heat emitting body 108*a*. A portion of the electrode pad 108*c*-1 which is connected to a connector 110*a* is exposed to an outside. A portion (i.e., a portion except the electrode pad 108*c*-1 connected to the connector 110*a*) of the plane heater 108 at which the heat emitting body 108*a* is formed may be covered by a shrinkable tube 156. The shrinkable tube 156 may be a tube which is cross-linked by the electron beam irradiation. At least one coupling member 127 passing through the plane heater 108 may be provided at the plane heater 108. The coupling member 127 serves to couple the plane heater 108 to the ice tray 102 when the plane heater 108 is installed at the ice tray 102.

Figure 7:
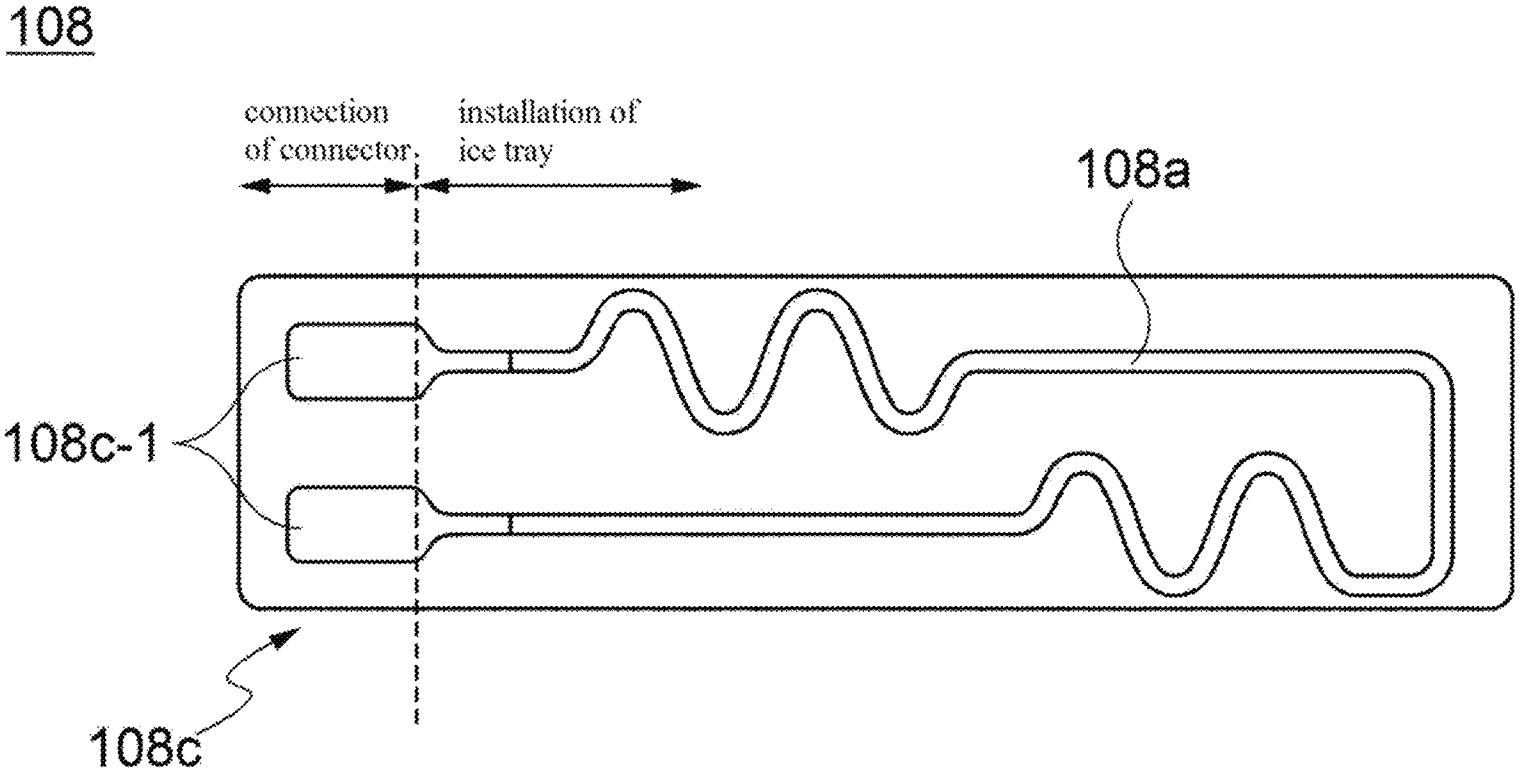
FIG. 7 is a view illustrating a plane heater according to a third embodiment of the present invention.

FIG. 7 is a view illustrating a plane heater according to a third embodiment of the present invention.

Referring to FIG. 7, a width or a surface area of an electrode pad 108*c*-1 provided at a power source connection part 108*c* of the plane heater 108 may be formed differently according to a position thereof. For example, a portion of the electrode pad 108*c*-1 which is connected to a connector 110*a* may be formed to have a wider surface area or width than that of a portion thereof installed at the ice tray 102. In addition, a width of the electrode pad 108*c*-1 may be provided wider than that of a heat emitting body 108*a*. That is, FIG. 7 has illustrated that a portion of the electrode pad 108*c*-1 which is connected to the heat emitting body 108*a* is formed to have the same width as that of the heat emitting body 108*a*, but the present invention is not limited thereto. The electrode pad 108*c*-1 may be formed to have a width wider than that of the heat emitting body 108*a*.

Meanwhile, the plane heater 108 may have a different heat emitting density according to a position thereof. That is, the plane heater 108 may be formed so that a surface area of the heat emitting body 108*a* per unit surface area thereof is changed, and thus the heat emitting density may be changed according to the position of the plane heater 108.

Figure 8A:
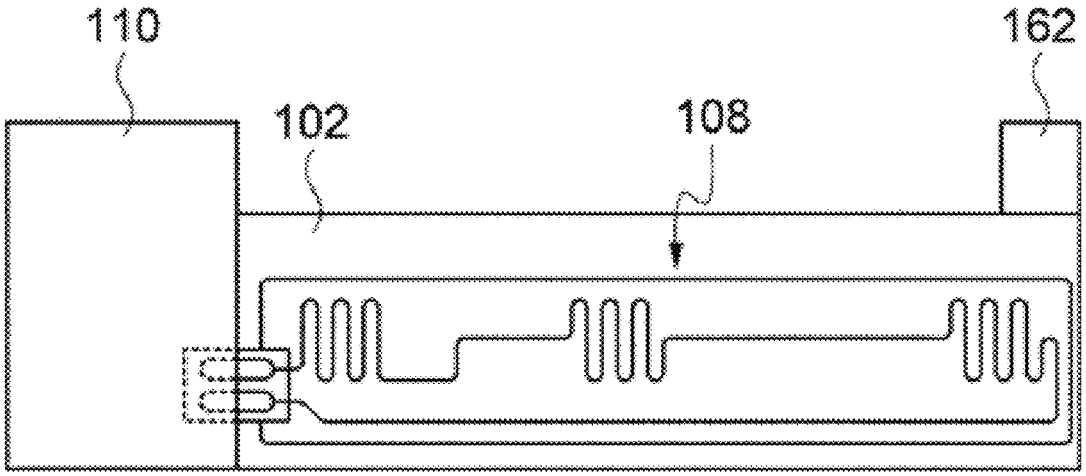
FIGS. 8(A) and 8(B) are views schematically illustrating a state in which the plane heater according to the third embodiment of the present invention is installed at the ice tray.
Figure 8B:
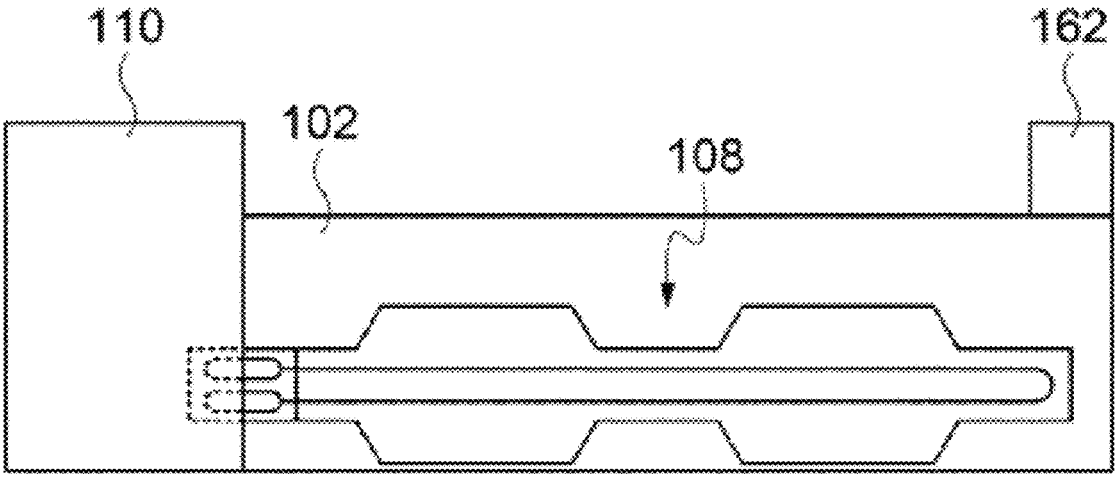

FIGS. 8(A) and 8(B) is a view schematically illustrating a state in which the plane heater according to the third embodiment of the present invention is installed at the ice tray.

Referring to FIG. 8(A), the plane heater 108 may be provided at the outer circumferential surface of the ice tray 102. The plane heater 108 may be provided from one end of the ice tray 102 to the other end thereof along a lengthwise direction of the ice tray 102. The control box 110 may be provided at one end of the ice tray 102 to face the ice tray 102. A water supply part 162 which supplies the ice-making water into the ice tray 102 may be provided at an upper side of the other end of the ice tray 102.

Here, the plane heater 108 may be formed so that the heat emitting density is changed according to a position corresponding to the ice tray 102. For example, portions of the plane heater 108 corresponding to one end of the ice tray 102 and the other end thereof may be formed to have the heat emitting density (e.g., the density per unit surface area of the heat emitting body, or the like) higher than that of other portions thereof. Since a structure such as the control box 110 is provided at one end of the ice tray 102 and a structure such as a water supply part 162 is provided at the other end of the ice tray 102, the heat may escape to other structures when the ice tray 102 is heated through the plane heater 108. Therefore, since the portions of the plane heater 108 corresponding to one end of the ice tray 102 and the other end thereof are formed to have the heat emitting density higher than that of other portions thereof, the ice may be evenly separated from an entire area of the ice tray 102. In addition, a portion of the plane heater 108 corresponding to a center of the ice tray 102 may be formed to have the heat emitting density lower or higher than that of other portions.

Referring to FIG. 8(B), the plane heater 108 may be formed to have a different surface area (or heat emitting area) according to a position thereof corresponding to the ice tray 102. That is, the surface area or the heat emitting area of the plane heater 108 may be formed differently according to the position thereof to evenly separate the ice in an entire area of the ice tray. At this time, the heat emitting density may be further increased by increasing a density of the heat emitting body 108*a* at a portion of the plane heater 108 having a narrow surface area. Moreover, the heat emitting density may also be further reduced by reducing the density of the heat emitting body 108*a* at a portion of the plane heater 108 having a wide surface area. However, the present invention is not limited thereto. The density of the heat emitting body 108*a* may be reduced at the portion of the plane heater 108 having the narrow surface area, and the density of the heat emitting body 108*a* may be increased at the portion of the plane heater 108 having the wide surface area.

Figure 9A:
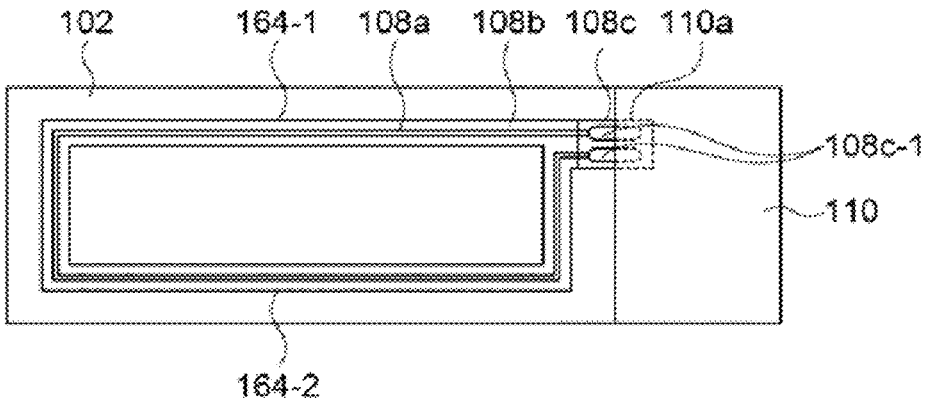
FIGS. 9(A) to 9(C) are views schematically illustrating a state in which a plane heater according to a fourth embodiment of the present invention is installed at the ice machine.
Figure 9B:
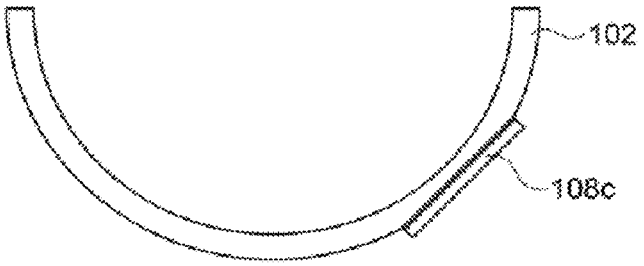
Figure 9C:
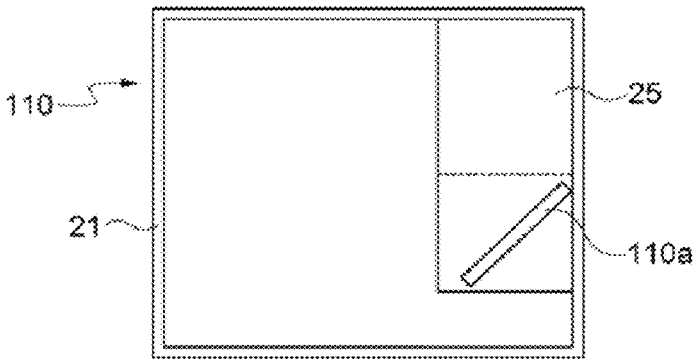

FIGS. 9(A) to 9(C) are a view schematically illustrating a state in which a plane heater according to a fourth embodiment of the present invention is installed at the ice machine. FIG. 9(A) is a view of the ice machine when being seen from a lower side thereof, FIG. 9(B) is a view of one end of the ice tray when being seen from a front side thereof, and FIG. 9(C) is a view of an inside of the control box when being seen from a front side thereof.

Referring to FIGS. 9(A) to 9(C) a plane heater 108 may be provided at the outer circumferential surface of the ice tray 102. A power source connection part 108*c* of the plane heater 108 may be formed so that one end thereof protrudes from one side surface (a right side surface based on a center of the ice tray 102 in FIG. 9(B)) of the outer circumferential surface of the ice tray 102 toward the control box 110. The plane heater 108 may include a first plane heater part 164-1 provided at one side surface of the outer circumferential surface of the ice tray 102 along the lengthwise direction of the ice tray 102 and a second plane heater part 164-2 provided at the other side surface of the outer circumferential surface of the ice tray 102 along the lengthwise direction of the ice tray 102. An area of the ice tray between the first plane heater part 164-1 and the second plane heater part 164-2 may be exposed to an outside to form the cool air contact section.

One end of the first plane heater part 164-1 and one end of the second plane heater part 164-2 are connected to the power source connection part 110*c*. At this time, the second plane heater part 164-2 may be bent from the other side surface of the outer circumferential surface of the ice tray 102 to one side surface thereof and may be connected to the power source connection part 110*c*. As described above, a plurality of heat emitting bodies 108*a* of the plane heater 108 may be provided to be branched from the power source connection part 108*c*.

The other end of the first plane heater part 164-1 and the other end of the second plane heater part 164-2 are connected to each other. For example, the other end of the first plane heater part 164-1 may be bent from one side surface of the outer circumferential surface of the ice tray 102 to the other side surface thereof and may be connected to the other end of the second plane heater part 164-2. Alternatively, the other end of the second plane heater part 164-2 may be bent from the other side surface of the outer circumferential surface of the ice tray 102 to one side surface thereof and may be connected to the other end of the first plane heater part 164-1. However, the present invention is not limited thereto, and the other end of the first plane heater part 164-1 and the other end of the second plane heater part 164-2 may be spaced apart from each other. In this case, the first plane heater part 164-1 and the second plane heater part 164-2 may be electrically connected to positive and negative electrode pads of the power source connection part 108*c*, respectively.

The plane heater 108 may be formed in a closed loop type at the outer circumferential surface of the ice tray 102, and may also be formed in a partially opened loop type. In this case, the cool air contact section may be ensured with one plane heater 108 while a contact surface area (or a heat emitting surface area) with the ice tray 102 is increased.

Meanwhile, a printed circuit board 25 on which the connector 110*a* is formed may be provided inside the control box 110. The printed circuit board 25 may be a main board on which a controller (not shown) for controlling an entire operation of the ice machine 100 is provided. The printed circuit board 25 may be provided at a side inside a housing 21 of the control box 110 corresponding to the power source connection part 108*c*. That is, the printed circuit board 25 may be provided to be biased to a right side of FIG. 9(C) based on a center of the housing 21.

As described above, since the power source connection part 108*c* of the plane heater 108 protrudes from one side surface of the outer circumferential surface of the ice tray 102 toward the control box 110 and the printed circuit board 25 is provided at the side inside the control box 110 corresponding to the power source connection part 108*c*, the connector 110*a* connected to the power source connection part 108*c* may be provided on the printed circuit board 25 without separately extending the printed circuit board 25 or deforming a size and a shape thereof.

Here, it has been described that the power source connection part 108*c* is provided at one side surface of the outer circumferential surface of the ice tray 102, but the present invention is not limited thereto, as long as the power source connection part 108*c* is provided to be biased to a right side or left side of FIG. 9(B) based on a center of the ice tray 102.

Figure 10:
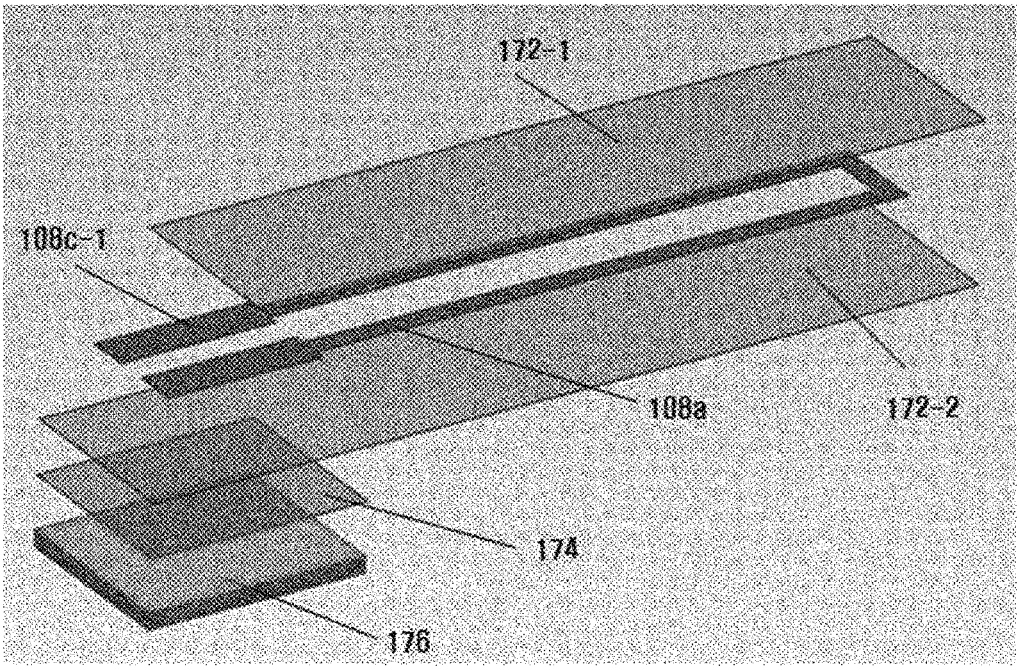
FIGS. 10 to 12 are views illustrating a plane heater according to a fifth embodiment of the present invention.

FIG. 10 is an exploded perspective view of a plane heater according to a fifth embodiment of the present invention.

Referring to FIG. 10, in a plane heater 108, a heat emitting body 108*a* and an electrode pad 108*c*-1 may be formed in a metal thin film. At this time, the heat emitting body 108*a* and the electrode pad 108*c*-1 may be integrally formed with each other. A first heat insulation film 172-1 may be provided on an upper surface of the heat emitting body 108*a*. A second heat insulation film 172-2 may be provided on a lower surface of each of the heat emitting body 108*a* and the electrode pad 108*c*-1. That is, the first heat insulation film 172-1 and the second heat insulation film 172-2 may be provided to cover the heat emitting body 108*a*. In addition, an upper surface of the electrode pad 108*c*-1 is exposed to an outside. The first heat insulation film 172-1 and the second heat insulation film 172-2 may be formed of a polyimide material.

An adhesive member 174 and a support plate 176 may be provided in turn below the second heat insulation film 172-2 provided at the lower surface of the electrode pad 108*c*-1. The adhesive member 174 serves to bond the second insulation film 172-2 and the support plate 176. Here, the electrode pad 108*c*-1 and structures (i.e., the second heat insulation film 172-2, the adhesive member 174 and the support plate 176) provided at the lower portion of the electrode pad 108*c*-1 form the power source connection part 108*c*. The support plate 176 serves to support a structure provided on the support plate 176. The support plate 176 may be configured with a PCB, a metal PCB, a plastic material or the like.

Figure 11:
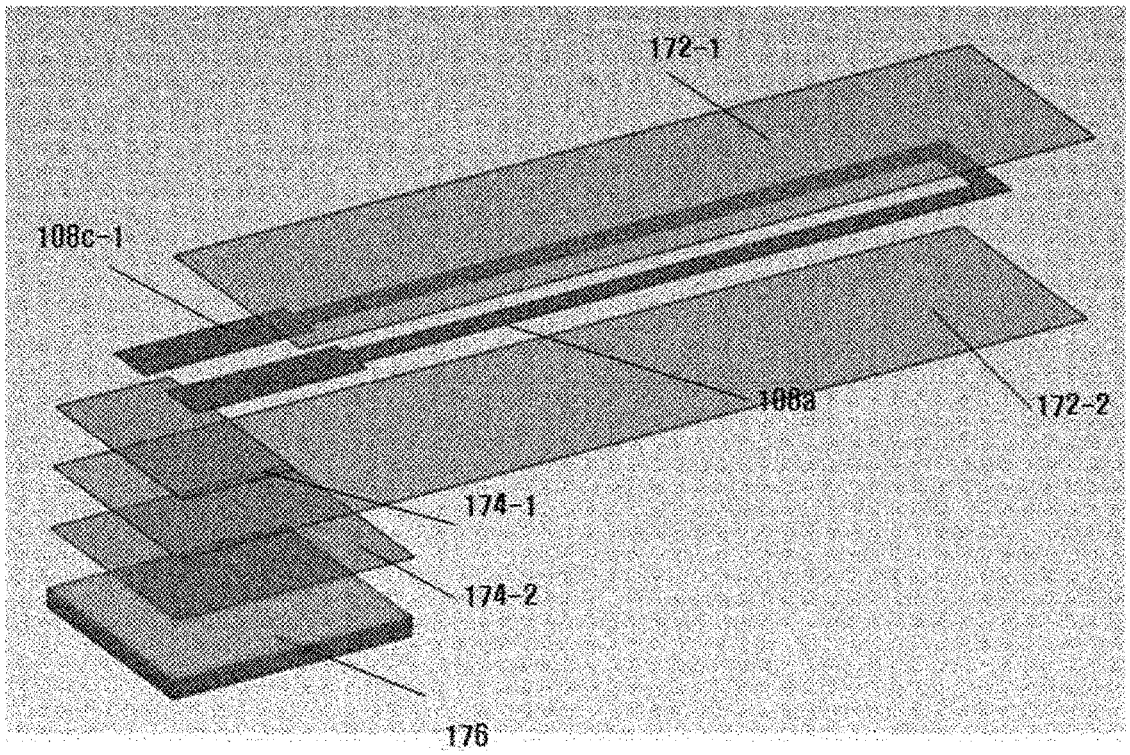

Additionally, as illustrated in FIG. 11, a first adhesive member 174-1 may be provided between the electrode pad 108*c*-1 and one surface of the second heat insulation film 172-2, and a second adhesive member 174-2 may be provided between the other surface of the second heat insulation film 172-2 and the support plate 174-1. The to electrode pad 108*c*-1 and the second heat insulation film 172-2 may be bonded through the first adhesive member 174-1, and the second heat insulation film 172-2 and the support plate 176 may be bonded through the second adhesive member 174-2.

Figure 12:
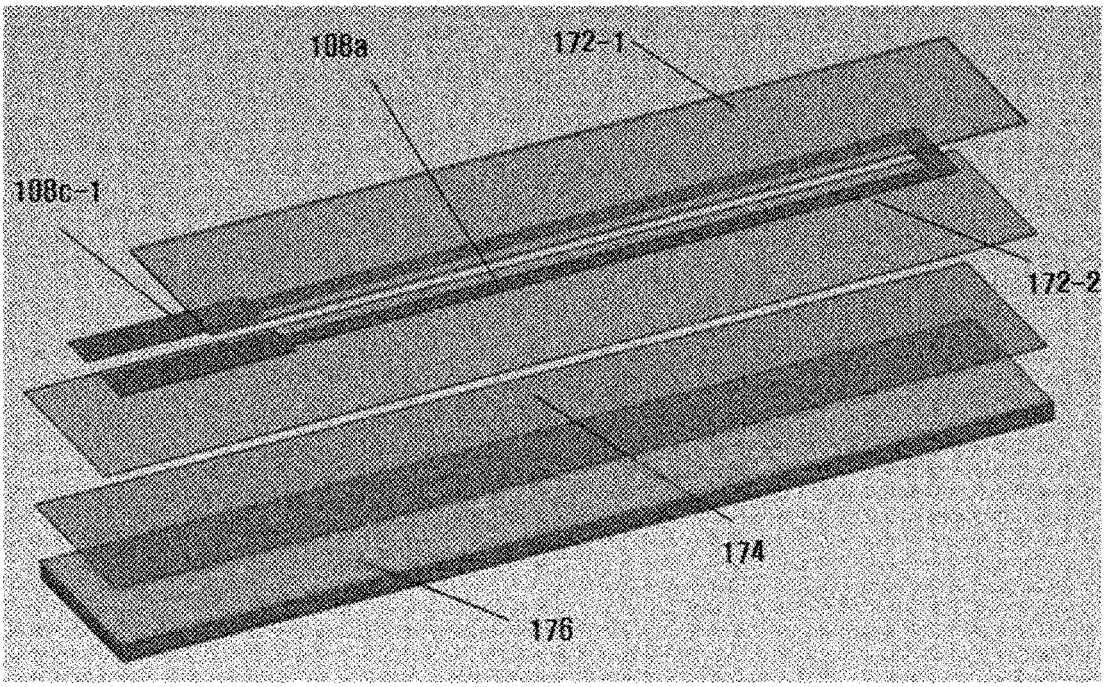

Moreover, as illustrated in FIG. 12, the adhesive member 174 and the support plate 176 may be provided to extend in a lengthwise direction of the plane heater 108. That is, the adhesive member 174 and the support plate 176 may be provided to extend toward the heat emitting body 108*a*, thereby supporting the heat emitting body 108*a*.

Figure 13:
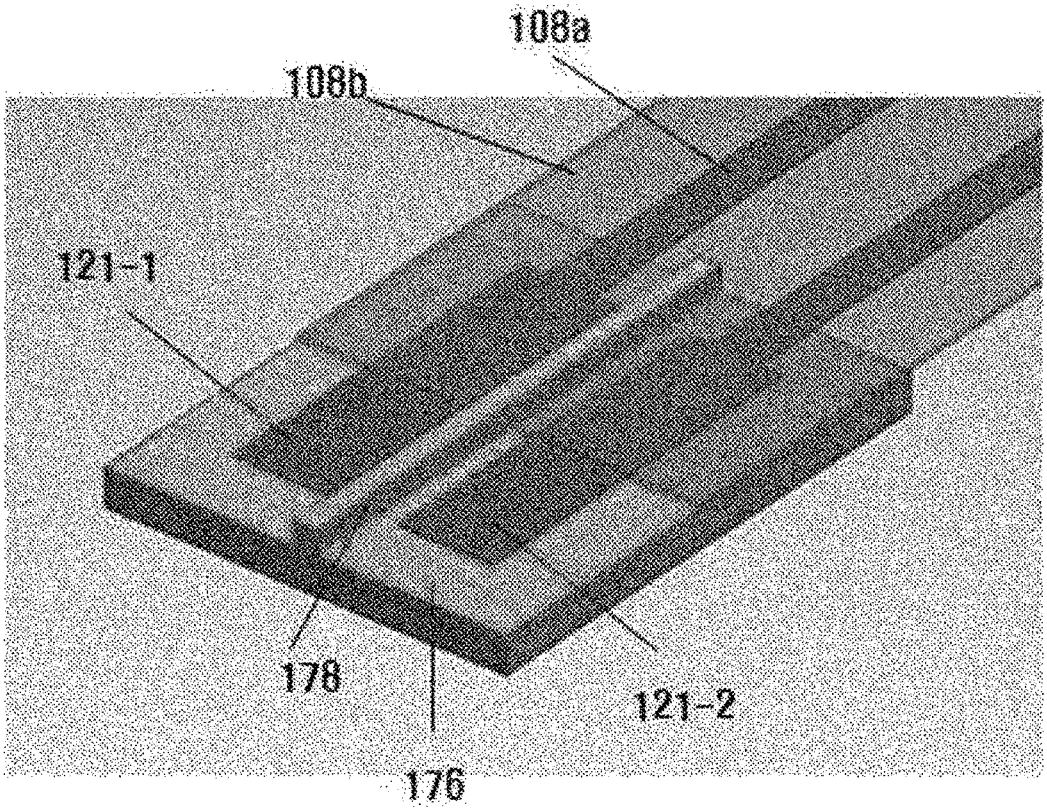
FIG. 13 is a view illustrating a plane heater according to a sixth embodiment of the present invention.

FIG. 13 is a view illustrating a plane heater according to a sixth embodiment of the present invention.

Referring to FIG. 13, one end of the heat emitting body 108*a* may be connected to a 1-1st electrode pad 121-1 on the support plate 176. The other end of the heat emitting body 108*a* may be connected to a 1-2nd electrode pad 121-2 on the support plate 176. Here, a partition part 178 may be provided on the support plate 176 between the 1-1st electrode pad 121-1 and the 1-2nd electrode pad 121-2. The partition part 178 may protrude from the support plate 176 and may be provided from one end of the support plate 176 to the other end thereof along a lengthwise direction of the support plate 176. However, the present invention is not limited thereto, and the partition part 178 may be provided at the support plate 176 in the form of a groove shape. The partition part 178 serves to electrically and physically partition (block) between the 1-1st electrode pad 121-1 and the 1-2nd electrode pad 121-2.

Figure 14A:
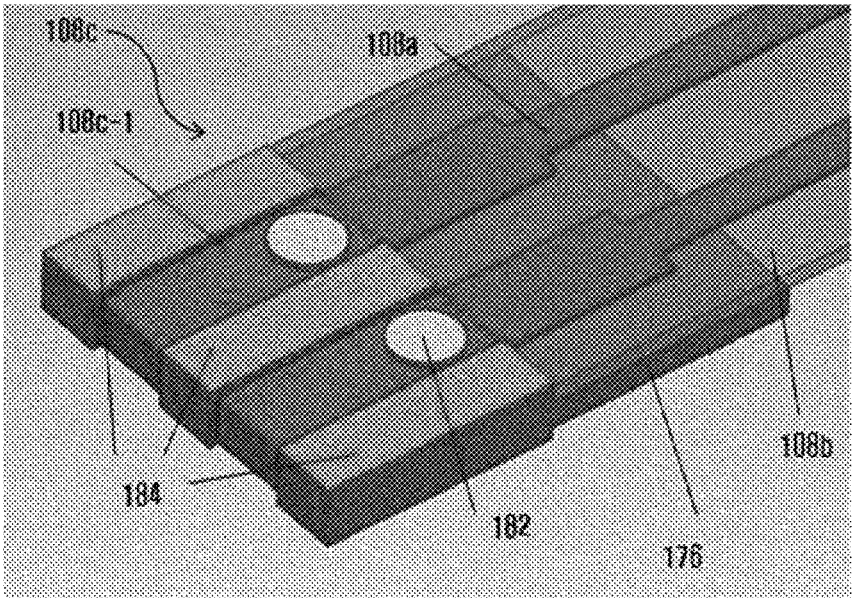
FIGS. 14(A) and 14(B) are views illustrating a plane heater according to a seventh embodiment of the present invention.
Figure 14:
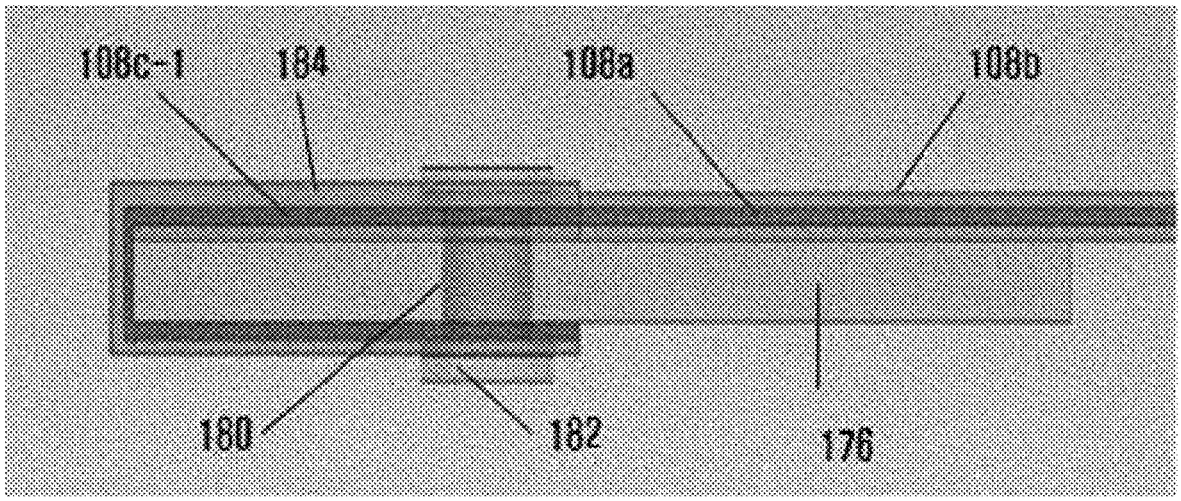

FIGS. 14(A) and 14(B) are views illustrating a plane heater according to a seventh embodiment of the present invention. FIG. 14(A) is a perspective view of the plane heater according to the seventh embodiment of the present invention, and FIG. 14(B) is a cross-sectional view of the plane heater according to the seventh embodiment of the present invention.

Referring to FIGS. 14(A) and 14(B), an electrode pad 108*c*-1 may be connected to a heat emitting body 108*a* on an upper surface of a support plate 176. The electrode pad 108*c*-1 may be provided along a lengthwise direction of the support plate 176 (i.e., a direction which is connected to a connector 110*a*) to a distal end of the support plate 176 on the upper surface of the support plate 176. In addition, the electrode pad 108*c*-1 may be provided to extend from the distal end of the support plate 176 to a lower surface of the support plate 176 in a predetermined length. An electrode pad guide part 184 may be provided at a side portion of the electrode pad 108*c*-1 on the support plate 176 along the electrode pad 108*c*-1. The electrode pad guide part 184 may be provided between the electrode pads 108*c*-1 and at one side of each of the electrode pads 108*c*-1. The electrode pad guide part 184 may be provided to protrude from a surface of the support plate 176 in a predetermined height. For example, the electrode pad guide part 184 may be provided to protrude from the surface of the support plate 176 in a thickness thicker than that of the electrode pad 108*c*-1. The electrode pad 108*c*-1 provided at the upper surface and the lower surface of the support plate 176 may be fixed by a coupling member 182 passing through the power source connection part 108*c*. A through-hole 180 passing through the power source connection part 108*c* may be provided at the power source connection part 108*c*. The through-hole 180 may be provided to pass through the electrode pad 108*c*-1 provided on the upper surface of the support plate 176, the support plate 176 and the electrode pad 108*c*-1 provided on the lower surface of the support plate 176. The coupling member 182 may be inserted into the through-hole 180 and thus may couple the electrode pad 108*c*-1 to the support plate 176. A rivet, a bolt, an eyelet, a screw or the like may be used as the coupling member 182.

Figure 15A:
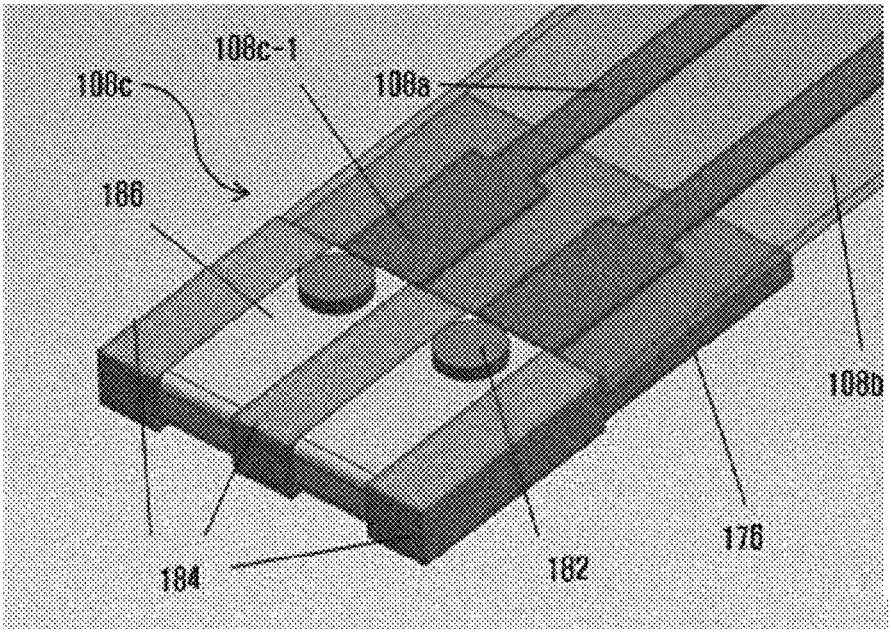
FIGS. 15(A) and 15(B) are views illustrating a plane heater according to an eighth embodiment of the present invention.
Figure 15B:
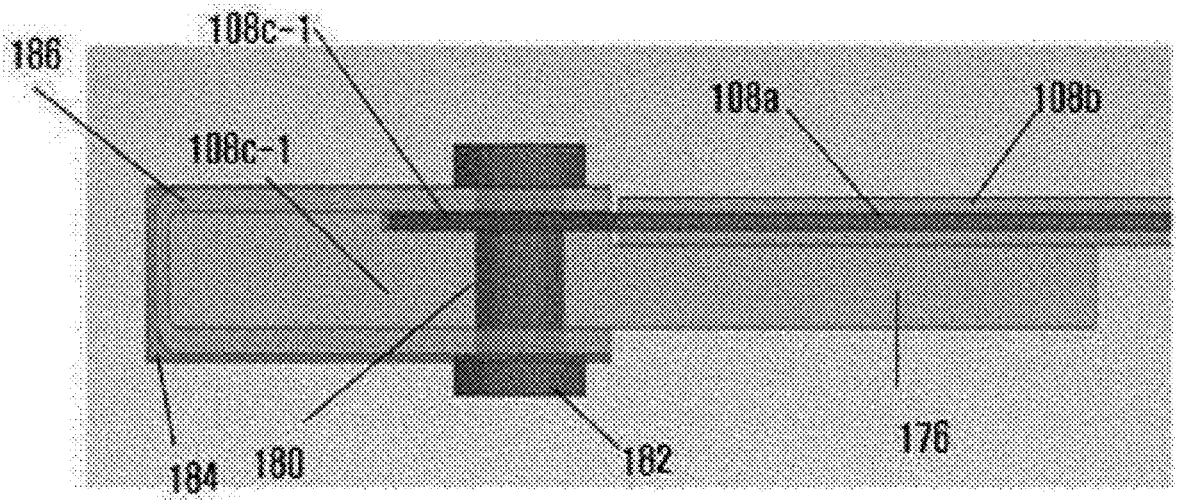

FIGS. 15(A) and 15(B) is a view illustrating a plane heater according to an eighth embodiment of the present invention. FIG. 15(A) is a perspective view of the plane heater according to the eighth embodiment of the present invention, and FIG. 15(B) is a cross-sectional view of the plane heater according to the eighth embodiment of the present invention. Here, parts which are different from the embodiment of FIGS. 14(A) and 14(B) will be described.

Referring to FIGS. 15(A) and 15(B), an electrode pad 108*c*-1 may be connected to a heat emitting body 108*a* at one side of an upper surface of a support plate 176. Moreover, a metal connection member 186 may be inserted into an end of the support plate 176 and may be electrically connected to the electrode pad 108*c*-1. The metal connection member 186 may be formed in a "=" shape. One end of the metal connection member 186 is electrically connected to the electrode pad 108*c*-1 on the upper surface of the support plate 176. The metal connection member 186 may be may be provided along a lengthwise direction of the support plate 176 (i.e., a direction which is connected to a connector 110*a*) to a distal end of the support plate 176. Moreover, the metal connection member 186 may be provided to extend from the distal end of the support plate 176 to a lower surface of the support plate 176 in a predetermined length. The metal connection member 186 may be provided to be vertically symmetric with respect to the support plate 176. The metal connection member 186 provided at the upper surface and the lower surface of the support plate 176 may be fixed by a coupling member 182 passing through the power source connection part 108*c*. The metal connection member 186 may be provided thicker than the thin film type electrode pad 108*c*-1. When the metal connection member 186 is connected to the connector 110*a*, heat emitting may be effectively restricted further than the case in which the thin film type electrode pad 108*c*-1 is connected to the connector 110*a*.

Figure 16:
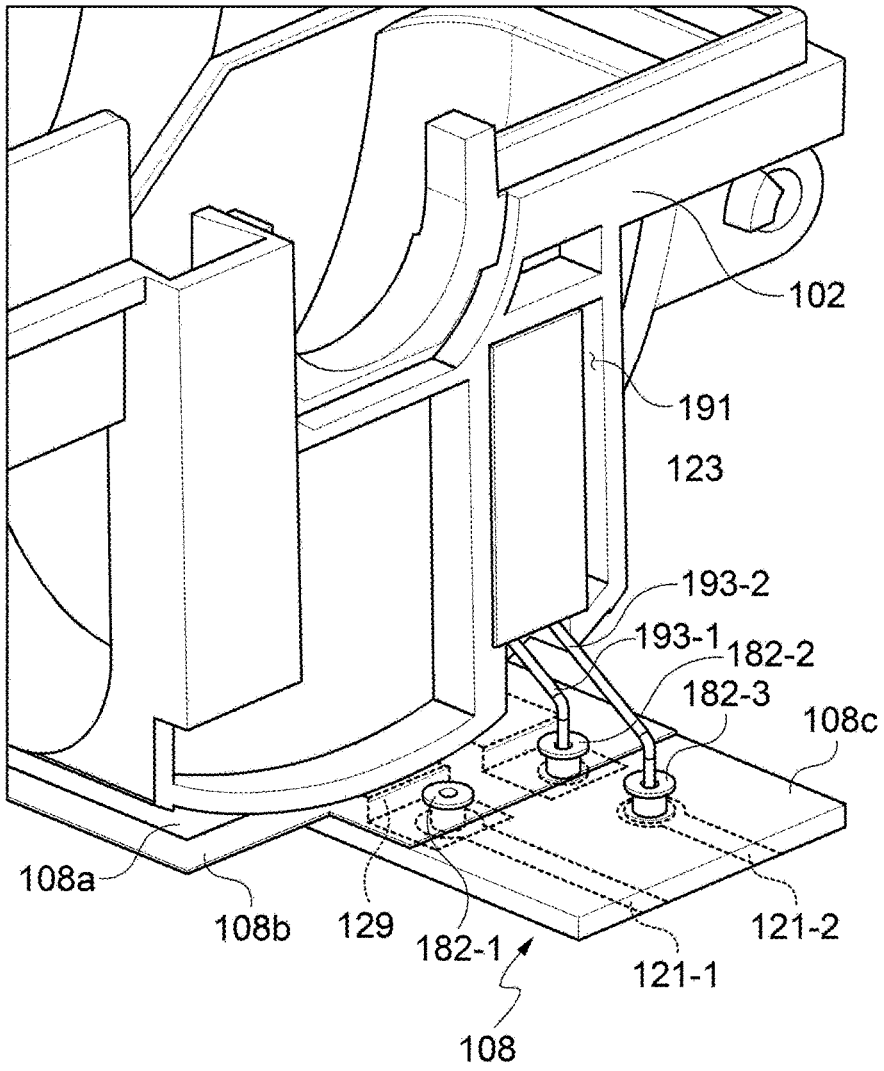
FIG. 16 is a view illustrating a state in which a power source disconnection part of the plane heater according to the embodiment of the present invention is installed at the ice tray.

FIG. 16 is a view illustrating a state in which a power source disconnection part of the plane heater according to the embodiment of the present invention is installed at the ice tray.

Referring to FIG. 16, a 1-1st electrode pad 121-1 and a 1-2nd electrode pad 121-2 may be provided at a lower surface of a power source connection part 108*c* of the plane heater 108. An end of each of a heat emitting body 108*a* and a heat insulation member 108*b* of the plane heater 108 may be fixed to an upper surface of the power source connection part 108*c*. At this time, the heat emitting body 108*a* may be inserted from an upper surface of the power source connection part 108*c* into the lower surface of the power source connection part 108*c* through an insertion hole 129 provided at the power source connection part 108*c*.

One end of the heat emitting body 108*a* may be electrically connected to the 1-1st electrode pad 121-1 on the lower surface of the power source connection part 108*c*. A first coupling member 182-1 may be provided at a portion thereof corresponding to one end of the heat emitting body 108*a* to pass through the power source connection part 108*c* from the heat insulation member 108*b* located at the upper surface of the power source connection part 108*c*. The first coupling member 182-1 serves to allow a stable electrical connection between one end of the heat emitting body 108*a* and the 1-1st electrode pad 121-1 while fixing the heat insulation member 108*b* and the heat emitting body 108*a* to the power source connection part 108*c*.

The other end of the heat emitting body 108*a* may be provided at the lower surface of the power source connection part 108*c* to be spaced apart from the 1-2nd electrode pad 121-2. A second coupling member 182-2 may be provided at a portion thereof corresponding to the other end of the heat emitting body 108*a* to pass through the power source connection part 108*c* from the heat insulation member 108*b* located at the upper surface of the power source connection part 108*c*. The second coupling member 182-2 serves to fix the heat insulation member 108*b* and the heat emitting body 108*a* to the power source connection part 108*c*. The second coupling member 182-2 is in contact with the other end of the heat emitting body 108*a* at the lower surface of the power source connection part 108*c*.

A third coupling member 182-3 may be provided at a portion thereof corresponding to the 1-2nd electrode pad 121-2 to pass through the power source connection part 108*c*. The third coupling member 182-3 is in contact with the 1-2nd electrode pad 121-2 at the lower surface of the power source connection part 108*c*.

Meanwhile, an accommodation groove 191 may be provided at an end surface (i.e., a surface facing the control box) of the ice tray 102. Moreover, a power source disconnection part 123 may be accommodated and fixed into the accommodation groove 191. The power source disconnection part 123 may be electrically connected to the second coupling member 182-2 by a first connection part 193-1. The power source disconnection part 123 may be electrically connected to the third coupling member 182-3 by a second connection part 193-2. That is, the power source disconnection part 123 may be provided to electrically connect the other end of the heat emitting body 108*a* and the 1-2nd electrode pad 121-2 by the first connection part 193-1 and the second connection part 193-2.

In the case in which the power source disconnection part 123 is provided at the ice tray 102, the electric power applied to the heat emitting body 108*a* may be cut off when a temperature of the ice tray 102 (or a temperature of the heat emitting body 108*a* which is directly detected without a separate temperature sensor exceeds a preset temperature. In this case, reliability of an operation of the power source disconnection part 123 may be increased. The power source disconnection part 123 may be configured with a temperature fuse or a bimetal. The coupling members 182-1, 182-2 and 182-3, the heat emitting body 108*a* and the first electrode pads 121-1 and 121-2 may be coupled by an arc welding, an electric welding or the like.

Here, it has been illustrated that the heat emitting body 108*a* and the first electrode pads 121-1 and 121-2 are provided at the lower surface of the power source connection part 108*c* and the first connection part 193-1 and the second connection part 193-2 are connected to the second coupling member 182-2 and the third coupling member 182-3, respectively, but the present invention is not limited thereto. The heat emitting body 108*a* and the first electrode pads 121-1 and 121-2 may be provided at the upper surface of the power source connection part 108*c*, and the first connection part 193-1 and the second connection part 193-2 may be electrically connected to the other end of the heat emitting body 108*a* and the 1-2nd electrode pad 121-2, respectively, without a separate coupling member. At this time, the first connection part 193-1 and the second connection part 193-2 may be electrically connected to the other end of the heat emitting body 108*a* and the 1-2nd electrode pad 121-2, respectively, through the arc welding or the electric welding. In addition, here, it has been described that one end of the heat emitting body 108*a* is electrically connected to the 1-1st electrode pad 121-1 through the first coupling member 182-1, but the present invention is not limited thereto. One end of the heat emitting body 108*a* may be electrically connected to the 1-1st electrode pad 121-1 through the arc welding or the electric welding without a separate coupling member.

Meanwhile, the first electrode pads 121-1 and 121-2 may be electrically connected to a main board inside the control box through a lead wire (not shown). That is, the connector may not be provided inside the control box. At this time, the power source connection part 108*c* may be electrically connected to the main board inside the control box through a lead wire (not shown).

Figure 17A:
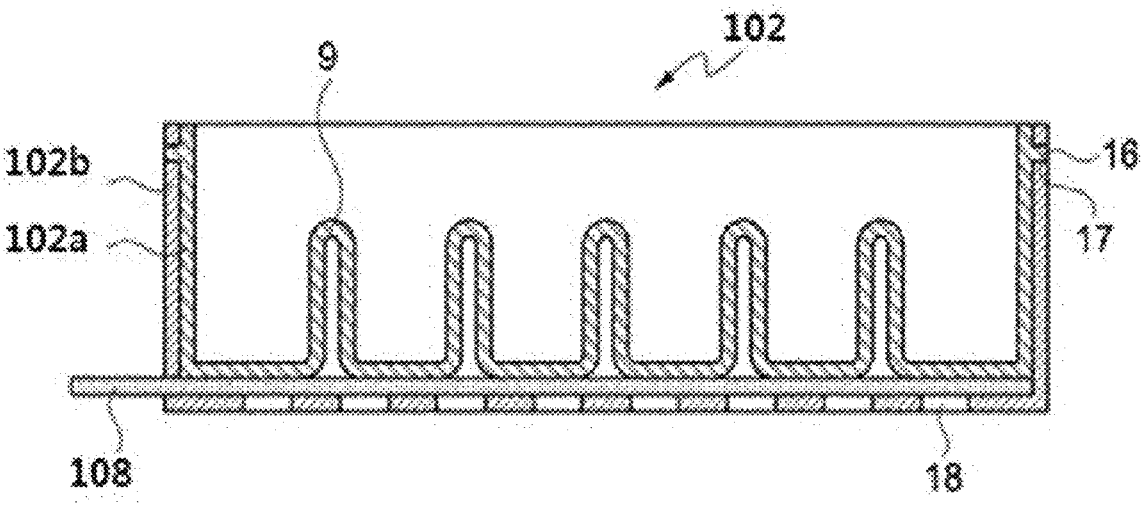
FIGS. 17(A) and 17(B) are views illustrating another example of the ice tray in the ice machine according to the embodiment of the present invention.
Figure 17B:
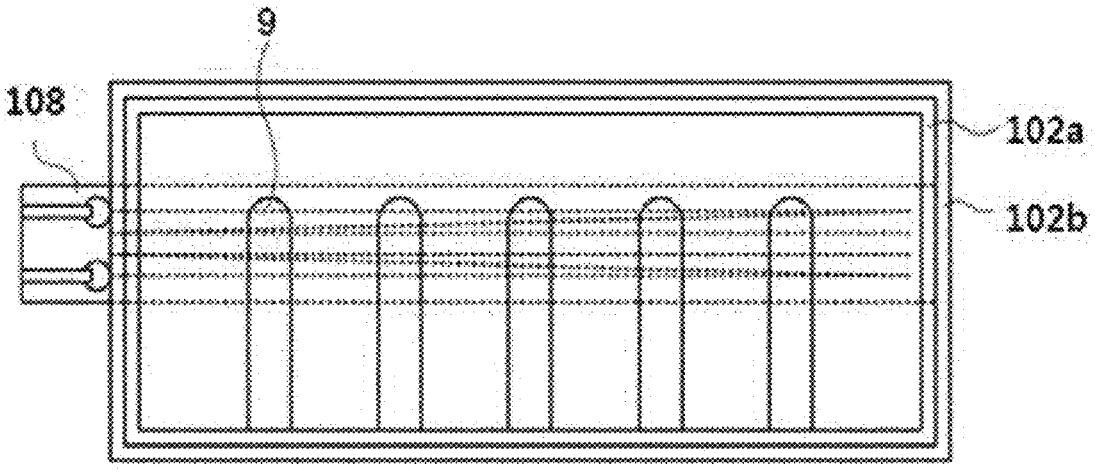

FIGS. 17(A) and 17(B) are views illustrating another example of the ice tray in the ice machine according to the embodiment of the present invention. FIGS. 17(A) and 17(B) are schematic lengthwise vertical cross-sectional view (FIG. 17(A)) and a plan view (FIG. 17(B)) illustrating a configuration of the ice tray 102 according to one embodiment of the present invention.

Referring to FIGS. 17(A) and 17(B), the ice tray 102 may include a first tray 102*a* formed of a metal thin film and a second tray 102*b* formed of a resin. However, the present invention is not limited thereto, and the first tray 102*a* may be formed of the resin and the second tray 102*b* may be formed of the metal thin film. Moreover, both of the first tray 102*a* and the second tray 102*b* may be formed of the resin or the metal thin film.

A plane heater 108 may be provided between the first tray 102*a* and the second tray 102*b*. The first tray 102*a* may be coupled into the second tray 102*b* to be overlapped therewith. For example, such a configuration may be realized by insert-injecting a resin into the first tray 102*a* formed of a metal and forming the second tray 102*b*.

For example, the first ray 102*a* may be formed by pressing (drawing) a metal thin film having a thickness of 0.5 mm or less or may be formed by an aluminum die casting. The first tray 102*a* may have a semicircular cross section and may have a vertical wall at both ends thereof. An internal space of the first tray 102*a* may be partitioned by a plurality of partition walls 9. Each of the partition walls 9 may be formed in a hollow shape. A hollow space of the partition wall 9 may be in communication with an outside of the ice tray 102 through a cut-out portion 18 formed at the second tray 102*b*, and thus the cool air may be more smoothly transmitted to water accommodated in the ice tray 102 through the first tray 102*a*, and an ice-making time may be shortened.

A protrusion 16 may be formed at an outer surface of the first tray 102*a*, i.e., an outer surface of the vertical wall and may be inserted into a corresponding groove 17 of the second tray 102*b*. Alternatively, the groove 17 and the protrusion 16 may be formed reversely, or the groove 17 and the protrusion 16 may be formed at both trays 102*a* and 102*b*. The protrusion may have various shapes such a cylindrical shape, a square pillar shape and a hook shape, and the groove may also have various corresponding shapes. By such a configuration, a bonding force between the first tray 102*a* and the second tray 102*b* may be enhanced, and the second tray 102*b* may be prevented from being separated from the first tray 102*a*. Furthermore, a concave-convex portion may be alternatively or additionally formed at an outer surface of the first tray 102*a*. The concave-convex portion may enhance the bonding force between the first tray 102*a* and the second tray 102*b* and may more effectively prevent the second tray 102*b* from being separated from the first tray 102*a*.

The concave-convex portion at the outer surface of the first tray 102*a* may be formed by, for example, an embossing process or a thermal spraying process. The second tray 102*b* of the ice tray 102 may be coupled to the first tray 102*a* to cover an outer surface of the first tray 102*a*, i.e., to cause the first tray 102*a* to be overlapped inside the second tray 102*b*. For example, such coupling may be achieved by insert-injecting the second tray 102*b* with respect to the first tray 102*a*. Due to such coupling, even when the first tray 102*a* is formed of the metal thin film, structural rigidity of the ice tray 102 may be maintained by the second tray 102*a*. At this time, while the plane heater 108 which is disposed between the first tray 102*a* and the second tray 102*b* is preliminarily bonded to the outer surface of the first tray 102*a* by an adhesive, the injection molding may be performed. The groove 17 corresponding to the protrusion 16 formed at the outer surface of the first tray 102*a* may be naturally formed by insert-injecting the second tray 102*b* with respect to the first tray 102*a*.

Further, a plurality of cut-out portions 18 through which the outer surface of the first tray 102*a*, e.g., an outer surface of a bottom portion is exposed may be formed at the second tray 102*b*. The cut-out portions 18 exposes the outer surface of the first tray 102*a*, particularly, the bottom portion, and shapes and positions thereof may be variously selected. However, the cut-out portions 18 may be arranged so that a portion of the ice tray 102 at which the cool air is further required, for example, the outer surface of the bottom portion adjacent to both ends is further exposed. Moreover, some of the cut-out portions 18 allow the outside of the ice tray 102 to be in communication with the hollow space of the partition wall 9 so that the cool air is introduced into the hollow space of the partition wall 9. Due to such a configuration, the cool air may be more effectively transmitted to the water accommodated in the ice tray 102, and the ice-making time may be shortened.

The plane heater 108 disposed between the first tray 102*a* and the second tray 102*b* may be inserted by insert-injecting the second tray 102*b* with respect to the outer surface of the first tray 102*a*. The plane heater 108 may be disposed at an area different from that at which the cut-out portions 18 formed at the second tray 102*b* are disposed and may not be exposed through the cut-out portions 18.

Although a few embodiments of the present invention have been shown and described, it would be appreciated by those skilled in the art that changes may be made in these embodiments without departing from the principles and spirit of the invention, the scope of which is defined in the claims and their equivalents.

The invention claimed is:

1. A plane heater provided at an ice tray of an ice machine which comprises the ice tray having a partitioned space to accommodate ice-making water, a motor provided to face the ice tray and a control box having a printed circuit board, the plane heater comprising:

a heat emitting body formed of a metal thin film and having a thickness thicker than 0 and equal to or thinner than 0.5 mm;

a heat insulation member provided to cover the heat emitting body; and a power source connection part including an electrode pad electrically connected to the heat emitting body and a support plate provided below the electrode pad.

2. The plane heater of claim 1, wherein the electrode pad of the power source connection part is connected to a connector provided at the printed circuit board inside the control box and transmits electric power to the heat emitting body.

3. The plane heater of claim 1, wherein the support plate extends in a lengthwise direction of the plane heater, and the heat emitting body is provided on the extending support plate, and the heat insulation member is provided on the extending support plate to cover the heat emitting body.

4. The plane heater of claim 1, further comprising a heat insulation film provided between the electrode pad and the support plate; and an adhesive member provided between the heat insulation film and the support plate to bond the heat insulation film to the support plate.

5. The plane heater of claim 1, wherein the plane heater is formed to have a different heat emitting density according to a position corresponding to the ice tray.

6. The plane heater of claim 1, wherein the plane heater is formed to have a different heat emitting surface area according to a position corresponding to the ice tray.

7. The plane heater of claim 1, wherein one side of each of the heat emitting body and the heat insulation member is fixed to a lower surface of the power source connection part, and one end of the heat emitting body is electrically connected to the electrode pad formed on an upper surface of the power source connection part through an insertion hole formed at the power source connection part.

8. The plane heater of claim 1, further comprising a power source disconnection part provided at the power source connection part to cut off electric power supplied to the heat emitting body of the plane heater when a temperature of the plane heater exceeds a preset temperature or a current exceeding a preset current flows.

9. The plane heater of claim 1, further comprising a temperature sensor provided at the power source connection part; and a second electrode pad electrically connected to the temperature sensor and connected to a connector provided at the printed circuit board inside the control box.

10. The plane heater of claim 1, wherein a width of the electrode pad is provided wider than that of the heat emitting body.

11. The plane heater of claim 1, wherein the power source connection part is connected to a connector provided at the printed circuit board inside the control box, and a portion of the electrode pad which is connected to the connector is provided to have a width or a surface area wider than that of a portion thereof connected to the heat emitting body.

12. The plane heater of claim 1, wherein the power source connection part is connected to a connector provided at the printed circuit board inside the control box, and the plane heater further includes a shrinkable tube provided to cover a portion except the power source connection part connected to the connector.

13. The plane heater of claim 1, wherein an outer cover of the plane heater is cross-linked by electron beam irradiation.

14. The plane heater of claim 1, comprising a first plane heater part of which one end is connected to the power source connection part and which is provided at one side of an outer circumferential surface of the ice tray along a lengthwise direction of the ice tray; and a second plane heater part of which one end is connected to the power source connection part and which is provided at the other side of an outer circumferential surface of the ice tray along the lengthwise direction of the ice tray.

15. The plane heater of claim 1, wherein the power source connection part is connected to a connector provided at the printed circuit board inside the control box, and a plurality of heat emitting bodies are provided to be branched from the power source connection part.

16. The plane heater of claim 1, wherein the power source connection part is provided to be biased to one side based on a center of a lengthwise direction of the plane heater.

17. The plane heater of claim 1, wherein a plurality of electrode pads are provided at the power source connection part, and the power source connection part further includes a partition part provided between the electrode pads on the support plate.

18. The plane heater of claim 1, wherein the electrode pad is fixed to the support plate by a coupling member provided to pass through the power source connection part.

19. The plane heater of claim 1, further comprising a metal connection member fitted to an end of the power source connection part, electrically connected to the electrode pad and fixed to the support plate, wherein the power source connection part is connected to a connector in which the metal connection member is provided at the printed circuit board inside the control box.

20. The plane heater of claim 1, further comprising a power source disconnection part configured to cut off power source applied to the heat emitting body under a preset condition, wherein the power source disconnection part is provided at the ice tray.

* * * * *